US007807911B2

(12) United States Patent
Izutani et al.

(10) Patent No.: US 7,807,911 B2
(45) Date of Patent: Oct. 5, 2010

(54) KEYBOARD MUSICAL INSTRUMENT HAVING KEYS EQUIPPED WITH BALANCERS BITING INTO KEYS AND METHOD FOR SECURING BALANCERS TO KEYS

(75) Inventors: Hitoshi Izutani, Shizuoka-ken (JP); Noboru Yamashita, Shizuoka-ken (JP); Satoshi Inoue, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/942,982

(22) Filed: Nov. 20, 2007

(65) Prior Publication Data

US 2008/0121093 A1 May 29, 2008

Related U.S. Application Data

(63) Continuation of application No. 11/068,971, filed on Mar. 2, 2005, now Pat. No. 7,345,235.

(30) Foreign Application Priority Data

| | | |
|---|---|---|
| Mar. 17, 2004 | (JP) | 2004-075631 |
| Mar. 22, 2004 | (JP) | 2004-083158 |
| Apr. 20, 2004 | (JP) | 2004-124142 |
| May 18, 2004 | (JP) | 2004-147278 |
| Sep. 15, 2004 | (JP) | 2004-267804 |

(51) Int. Cl.
*G10C 3/12* (2006.01)

(52) U.S. Cl. ..... 84/433; 84/439; 84/423 R; 411/451.1; 411/456

(58) Field of Classification Search ..... 84/423 R, 84/433, 439, 440; 248/316.2, 316.5, 230.2, 248/231.31, 231.9; 411/418, 349, 549, 456, 411/451.1

See application file for complete search history.

(56) References Cited

U.S. PATENT DOCUMENTS 2,117,832 A * 5/1938 Wellner ..... 411/449

(Continued)

FOREIGN PATENT DOCUMENTS

CN 1428764 A 7/2003

(Continued)

*Primary Examiner*—David S. Warren
(74) *Attorney, Agent, or Firm*—Dickstein Shapiro LLP

(57) ABSTRACT

Keys of an acoustic piano require balancers for cancellation of a part of self weight of the action units/hammers; however, the balancers are liable to be dropped off due to the aged deterioration of the wooden bars; in order to keep the balancers stable in the keys against the aged deterioration, the balancer is plastically deformed so as to bite into the wooden bar, the balancer, which is formed with thorns, is rotated so as to make the thorns bite into the wooden bar, the balancer is shaped into a configuration different from the holes so as to exert resilient force on the inner surface in a direction in parallel to the grain of wood, or the balancer is inserted into a constricted hole so as to strongly exert the resilient force on the inner surface, thereby being prevented from the dropping off from the keys.

12 Claims, 20 Drawing Sheets

U.S. PATENT DOCUMENTS 2,393,923 A * 1/1946 August ..... 411/456
3,171,321 A * 3/1965 Artur ..... 411/80.5
3,478,641 A * 11/1969 Dohmeier ..... 411/79
3,654,831 A 4/1972 Grilli et al.
3,956,803 A * 5/1976 Leitner ..... 411/349
4,827,609 A * 5/1989 Kawecki ..... 29/832
5,142,834 A * 9/1992 Laclave et al. ..... 52/208
5,158,003 A 10/1992 Lee
5,346,349 A * 9/1994 Giovannetti ..... 411/549
5,368,427 A * 11/1994 Pfaffinger ..... 411/553
5,468,109 A * 11/1995 Ferrari et al. ..... 411/553
5,498,108 A * 3/1996 Frandberg ..... 405/259.1
5,585,582 A 12/1996 Stanwood
5,591,927 A 1/1997 Kawamura et al.
5,704,750 A 1/1998 Bartos et al.
5,897,278 A * 4/1999 Frattarola ..... 411/549
5,897,401 A * 4/1999 Fili et al. ..... 439/733.1
6,109,578 A * 8/2000 Guthrie et al. ..... 248/231.9
6,116,836 A * 9/2000 Long, Sr. ..... 411/451.1
6,119,993 A * 9/2000 Youngblood et al. ..... 248/231.9
6,296,430 B1 * 10/2001 Fischer ..... 411/33
6,406,214 B1 * 6/2002 Chene ..... 403/350
6,435,790 B1 * 8/2002 Ichikawa ..... 411/349
6,531,651 B2 * 3/2003 Kanemitsu et al. ..... 84/433
6,540,463 B2 * 4/2003 Ward ..... 411/173
6,568,893 B2 * 5/2003 LeVey et al. ..... 411/349
6,575,682 B1 * 6/2003 Dohm et al. ..... 411/553
6,676,352 B2 * 1/2004 Chen-Chi et al. ..... 411/417
6,679,646 B2 * 1/2004 Quardt et al. ..... 403/348
6,779,232 B2 * 8/2004 Cerul ..... 16/2.1
6,935,527 B1 * 8/2005 Brock ..... 220/210
7,067,730 B2 6/2006 Inoue
2001/0036386 A1 * 11/2001 Chene ..... 403/374.2
2003/0047061 A1 * 3/2003 Kugimoto et al. ..... 84/433
2003/0077144 A1 * 4/2003 Perrot ..... 411/349
2003/0084776 A1 5/2003 Inoue
2004/0123728 A1 7/2004 Inoue
2004/0163526 A1 8/2004 Muramatsu
2004/0221711 A1 11/2004 Kato et al.
2005/0002753 A1 * 1/2005 Haas ..... 411/349
2005/0125818 A1 * 6/2005 Ito et al. ..... 720/720
2005/0211048 A1 9/2005 Fujiwara

FOREIGN PATENT DOCUMENTS

JP 2002-162960 6/2002
JP 2002-265793 9/2002
JP 2003-108113 4/2003
JP 2003-150148 5/2003
JP 2003-162279 6/2003

* cited by examiner

KEYBOARD MUSICAL INSTRUMENT HAVING KEYS EQUIPPED WITH BALANCERS BITING INTO KEYS AND METHOD FOR SECURING BALANCERS TO KEYS

This application is a continuation of co-pending U.S. application Ser. No. 11/068,971 filed Mar. 2, 2005, the disclosure of which is incorporated by reference.

FIELD OF THE INVENTION

This invention relates to a keyboard musical instrument and, more particularly, to a keyboard musical instrument having keys equipped with balancers and a method for assembling the balancers with keys.

DESCRIPTION OF THE RELATED ART

An acoustic piano belongs to the keyboard musical instrument. A player designates the pitch of tones to be produced through the keyboard during his or her performance. In other words, the keyboard offers an interface to players.

The keyboard includes plural keys, which are laid on the well-known pattern. Action units are respectively held in contact with the rear portions of the keys, and hammers, which are opposed to associated strings, are linked with the action units, respectively. Thus, the total weight of the action unit and hammer is exerted on the rear portion of each key.

When the player depresses the front portion of a key against the total weight of the associated action unit and hammer, the depressed key gives rise to rotation of the action unit, and the action unit forces the hammer to rotate. The player feels the total weight of the action unit and hammer exerted on the finger as the load against the key motion. When the jack, which forms a part of the action unit, is brought into contact with a regulating button, the jack escapes from the hammer, and the hammer starts freely to rotate toward the associated string. Then, the player feels the depressed key lighter than before. The change in resistance against the key motion is unique to the piano, and is called as "piano key touch".

The piano key touch originates from the variable load due to the action units and hammers. The total weight of action unit and hammer is not equal among the keys. Moreover, the players have accustomed themselves to the keys decreased in load from the lower-pitched part to the higher-pitched part. In this situation, the manufacturers used to regulate the keys to the ramped load by means of balancers made of lead. The lead is heavy, and gets to fit the keys. However, the lead is harmful. Various balancers made of non-lead material have been proposed.

One of the prior art balancers is disclosed in Japan Patent Application laid-open No. 2002-265793. The prior art balancer disclosed in the Japanese Patent Application laid-open is made of tungsten powder-containing synthetic resin, and is shaped into a column. The peripheral surface is smooth, and any spine does not project from the peripheral surface. A cylindrical hole or cylindrical holes are formed in the front portion of the key made of wood, and are open to the outside on both side surfaces of the wooden key. The cylindrical holes are slightly smaller in diameter than the prior art column-shaped balancers. The prior art balancers are pressed into the holes so as to be snugly received therein. While the prior art column-shaped balancer is proceeding into the cylindrical hole, the cylindrical hole is reamed with the prior art column-shaped balancer, and the prior art balancer gets to fit the key.

Although the prior art column-shaped balancers are stable in the cylindrical holes of the wooden key after the insertion, the wooden key tends to lose the resiliency during a long service time, and the prior art column-shaped balancers are liable to be dropped out. This is the first problem inherent in the prior art column-shaped balancers. If the piano is put in high-humidity environment, the wooden keys expand, and can not tightly hold the prior art column-shaped balancers. Another problem inherent in the prior art column-shaped balancers is that the wood keys are liable to be cracked. The grain of wood usually extends in parallel to the longitudinal direction of the wooden keys, and the wood has a large mechanical strength in the direction in parallel the grain rather than the direction vertical to the grain. While a worker is pressing the prior art column-shaped balancer into the cylindrical hole, the prior art column-shaped balancer is slightly shrunk by virtue of the synthetic resin, and isotropically exerts the resilient force on the inner surface which defines the cylindrical hole. Although the wooden key well withstands the resilient force in the direction parallel to the grain of the wood, the wooden key cracks in the direction parallel to the grain of the wood due to the resilient force exerted in the direction vertical to the grain. The column-shaped balancer disclosed in the Japanese Patent Application laid-open is hereinafter referred to as "the first prior art balancer".

Another prior art balancer is disclosed in Japanese Patent Application laid-open No. 2003-162279. The prior art balancer disclosed therein is hereinafter referred to as "the second prior art balancer". The second prior art balancer consists of a pair of weight pieces and a bolt. The weight piece has a configuration like a hat. In other words, a brim projects from the periphery of a crown, and a through-hole is formed in the weight piece. One of the weight pieces is formed with a female screw along the through-hole. A cylindrical hole or holes are formed in the front portion of the key, and are approximately equal in diameter to the crowns. However, the brims are larger in diameter than the cylindrical holes. The weight pieces are respectively inserted into the cylindrical hole from both sides of the key until the brims are brought into contact with the side surfaces of the key. The bolt is inserted into the through-hole of one of the weight pieces, and is brought into meshing engagement with the female screw. The weight pieces are connected with each other by means of the bolt in the cylindrical hole.

The brims do not permit the weight pieces to pass through the cylindrical hole, and the bolt joints the weight pieces. For this reason, the second prior art balancers are not dropped out from the keys. Moreover, the second prior art balancer does not exert any resilient force on the key so that the keys are free from the cracks. However, another problem is encountered in the second prior art balancer in that a large amount of time and labor is consumed in the assembling work. This is because of the fact that the second prior art balancer consists of the physically independent three parts.

Yet another prior art balancer, which is hereinafter referred to as "the third prior art balancer", is disclosed in Japanese Patent Application laid-open No. 2003-150148. The third prior art balancer has a configuration like a piece of bamboo. The third prior art balancer has several nodes like the bamboo joints. The nodes radially project from the trunk portion, and bite the inner surface portion of the wooden key which defines the through-hole. When a worker assembles the third prior art balancer with the wooden key, the worker roughly aligns the third prior art balancer with the through-hole, and presses the third prior art balancer into the through-hole. While the third prior art balancer is proceeding into the through-hole, the nodes scrape out the wood, and bores up the through-hole. For this reason, only the lead node strongly bites the wooden key, and the other nodes are softly engaged with the wooden key. When the end surface of the third prior art balancer becomes coplanar with the side surfaces of the wooden key, the worker by no means exerts the force on the third prior art balancer. Thus, the assembling work is easier than that for the second prior art balancer. Moreover, the third prior art balancer does not crack the wooden key.

However, the third balancer is unstable in the wooden key as similar to the first prior art balancer. Although the nodes do not permit the third prior art balancer to pass through the hole, the nodes are less effective against the backward motion toward the entrance of the through-hole. When the keys are repeatedly depressed and released, the lead node tends to be disengaged from the step between the large bore and the small bore. As a result, the third prior art balancer is liable to be rattled in the through-hole, and is finally dropped out from the wooden key.

As will be understood, there is a trade-off between the easiness of the assembling work and the stability of the prior art balancer inside the key.

SUMMARY OF THE INVENTION

It is therefore an important object of the present invention to provide a keyboard musical instrument, balancers of which are stable in keys without sacrifice of easiness of the assembling work.

It is also an important object of the present invention to provide a key, which is used in the keyboard musical instrument.

It is another important object of the present invention to provide a method for assembling the balancer with the key.

In accordance with one aspect of the present invention, there is provided a keyboard musical instrument comprising a tone generator generating tones and having self-weight and plural keys including respective end portions of bars connected to the tone generator so that the self-weight is exerted thereon and other end portions located at opposite sides to the end portions with respect to respective fulcrums of the bars and weighted with balancers for canceling part of the self-weight and selectively depressed by a player for specifying the pitch of the tones, and each of the balancers has a plastically deformed portion, which makes the aforesaid each of the balancers engaged with associated one of the bars.

In accordance with another aspect of the present invention, there is provided a keyboard musical instrument comprising a tone generator generating tones and having self-weight and plural keys including respective end portions of bars connected to the tone generator so that the self-weight is exerted thereon and other end portions located at opposite sides to the end portions with respect to respective fulcrums of the bars and weighted with resiliently deformed balancers for canceling part of the self-weight and selectively depressed by a player for specifying the pitch of the tones, and each of the plural keys is formed with at least one hole different in cross section from associated one of the resiliently deformed balancers so as to permit the associated one of the resiliently deformed balancers to exert resilient force on part of the inner surface defining the at least one hole in a direction parallel to a longitudinal direction of associated one of the bars.

In accordance with yet another aspect of the present invention, there is provided a keyboard musical instrument comprising a tone generator generating tones and having self-weight and plural keys including respective end portions of bars connected to the tone generator so that the self-weight is exerted thereon and other end portions located at opposite sides to the end portions with respect to respective fulcrums of the bars and weighted with resiliently deformed balancers for canceling part of the self-weight and selectively depressed by a player for specifying the pitch of the tones, and each of the plural keys is formed with at least one constricted hole where associated one of the resiliently deformed balancers is received so as to permit the aforesaid associated one of the resiliently deformed balancers to exert resilient force on an inner surface defining a constricted portion of the constricted hole.

In accordance with still another aspect of the present invention, there is provided a method for securing a balancer to a bar of a key incorporated in a keyboard musical instrument comprising the steps of a) preparing a balancer having at least one lodged portion and a bar formed with a hole, b) inserting the balancer into the hole, and c) moving the balancer in the hole so as to make the at least one lodged portion lodged in the bar.

BRIEF DESCRIPTION OF THE DRAWINGS

The features and advantages of the keyboard musical instrument, key and method will be more clearly understood from the following description taken in conjunction with the accompanying drawings, in which.

DESCRIPTION OF THE PREFERRED EMBODIMENTS

In the following description, term "front" is indicative of a position closer to a pianist, who is sitting for fingering, than a position modified with "rear". A line, which is drawn between a front point and a corresponding rear point, extends in a "fore-and-aft" direction, and a lateral direction crosses the fore-and-aft direction at right angle.

Figure 1:
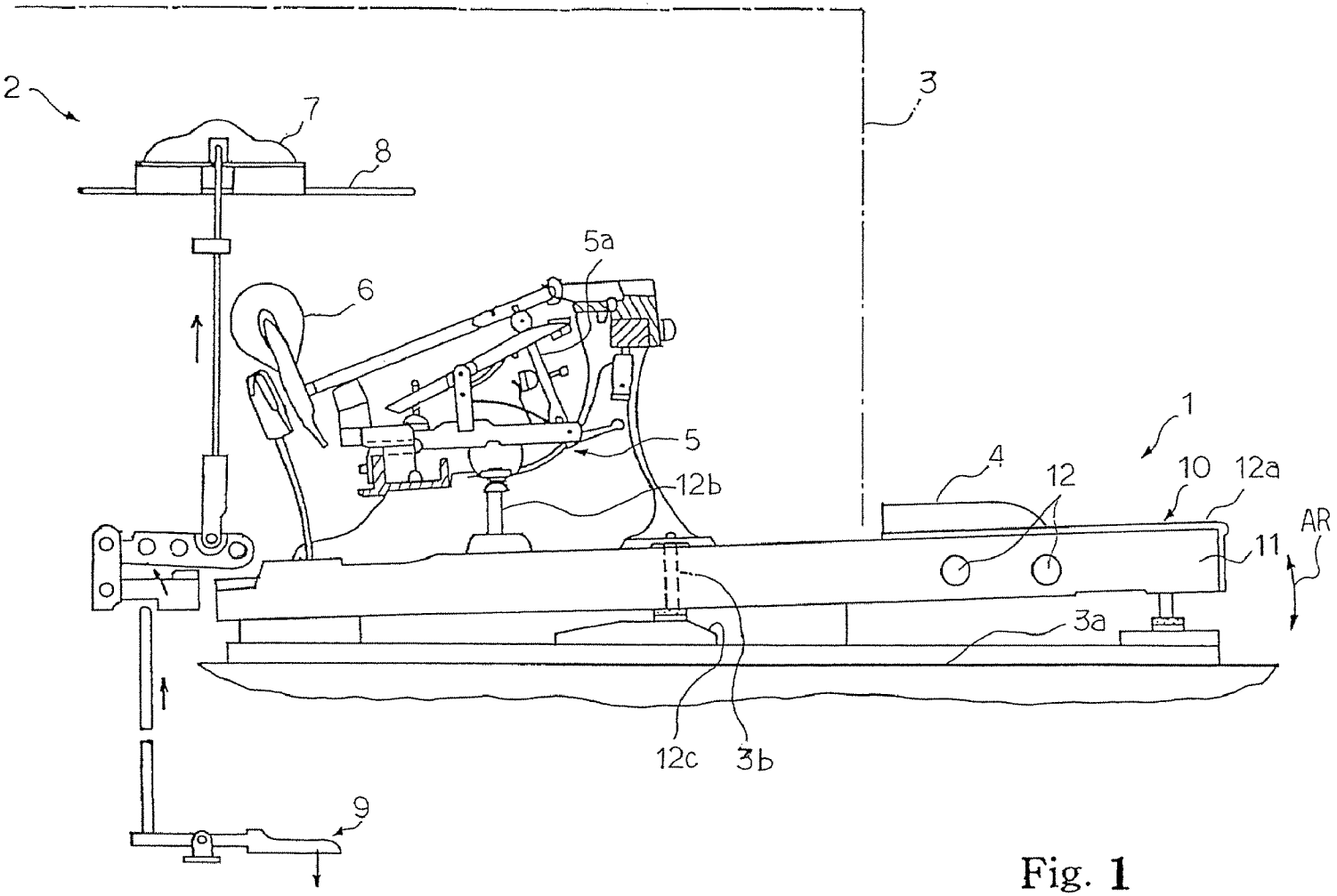
FIG. 1 is a side view showing the structure of a grand piano according to the present invention.

Description is firstly made on a grand piano of the present invention with reference to FIG. 1. The grand piano largely comprises a keyboard 1, a tone generating system 2 and a piano cabinet 3. The keyboard 1 is mounted on a front portion of the piano cabinet 3, and is exposed to the pianist. The tone generating system 2 is housed in the piano cabinet 3, and is linked with the keyboard 1. While the pianist is fingering on the keyboard 1, the keyboard 1 notifies the tone generating system 2 of the pitch of the tones to be produced, and the tones are produced through the tone generating system 2.

The keyboard 1 is mounted on a key bed 3*a*, and includes black keys 4 and white keys 10. The black keys 4 and white keys 10 are laterally laid on the well-known pattern, and the black and white keys 4/10 are independently rotatable about balance pins 3*b* as indicated by arrow AR1. The tone generating system 2 includes plural action units 5, hammers 6, dampers 7, strings 8 and a pedal system 9. The black/white keys 4/10 are respectively linked with the action units 5 at capstan screws 12*b* and with the dampers 7 at the rear end portions. Thus, the black and white keys 4/10 actuate the associated action units 5 and associated dampers 7 on the way from respective rest positions to respective end positions. The hammers 6 are respectively linked with the action units 5 at respective jacks 5*a*, and the strings 8 are stretched over the associated hammers 6. The dampers 7 aim at restriction on vibrations of the strings 8, and the pedal system 9 imparts the well-known artificial expressions to the tones.

The dampers 7 are spaced from the associated strings 8 on the way toward the end positions so as to permit the strings 8 to vibrate. The jacks 5*a* escape from the hammers 6 also on the way of the end positions so as to give rise to free rotation of the hammers 6, and the associated strings 8 are struck with the hammers 6 at the end of the free rotation. Then, the strings 8 start to vibrate for producing the tones at the pitch designated through the black/white keys 4/10. When the pianist releases the depressed keys 4/10, the black/white keys 4/10 start to return to the respective end positions. The dampers 6 are brought into contact with the vibrating strings 8 on the way toward the rest positions, and make the vibrations decayed. Thus, the action units 5, hammers 6, dampers 7, strings 8 and pedal system 9 behave similar to those of a standard grand piano, and no further description is hereinafter incorporated for the sake of simplicity.

A wooden bar 11, balancers 12 and a covering plate 12*a* form each of the white keys 10, and the black keys 4 are similarly formed. The wooden bars 11 are elongated in the fore-and-aft direction, and are rest on a balance rail 12*c*. A pair of balancers 12 are embedded in the front portion of the key 4/10, and the upper surface and front end surface of the key 4/10 are decorated with the covering plate 12*a*.

As described hereinbefore, the black and white keys 4/10 are connected through the capstan screws 12*b* to the action units 5, and the action units 5 are respectively connected at the heads of the jacks 5*a* to the hammers 6. This results in that the hammer 6 and action unit 5 exert their weights through the capstan screws 12*b* on the rear portions of the associated key 4 or 10. When the pianist depresses the black or white key 4/10, he or she has to exert the force on the front portion of the key 4/10 against the total weight of the action unit and hammer 5/6. If the balancers 12 were not embedded in the key 4/10, the pianist would feel the key 4/10 too heavy. The balancers 12 partially cancel the load on the black and white keys 4/10. For this reason, the pianist can easily depress the black/white keys 4/10.

In order to accomplish the objects of the present invention, several sorts of balancers 12 are employable in the keys 4 and 10 in accordance with the present invention. Description is focused on the several sorts of balancers 12.

First Embodiment

Figure 2:
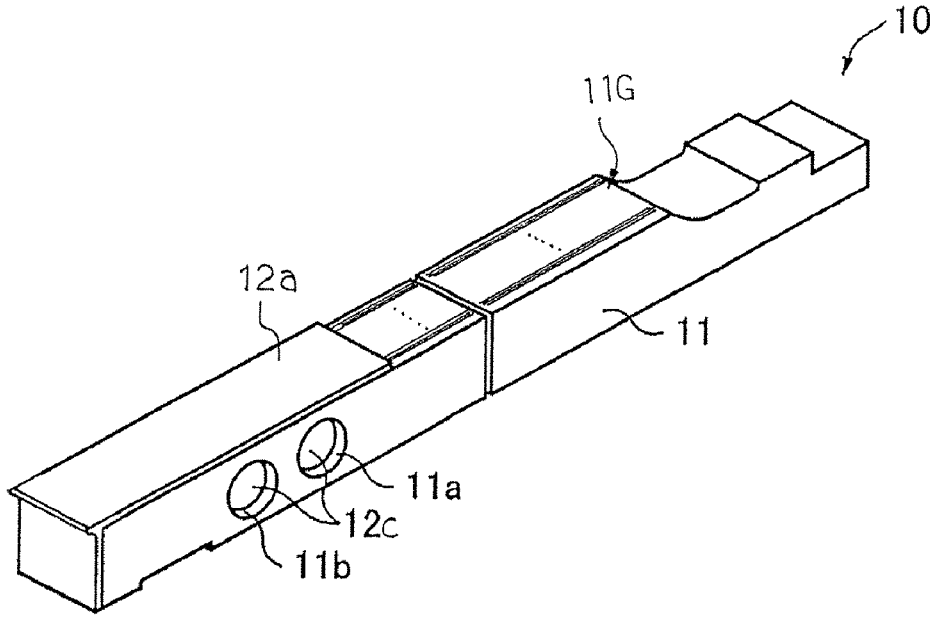
FIG. 2 is a perspective view showing the key incorporated in the grand piano implementing the first embodiment.
Figure 3:
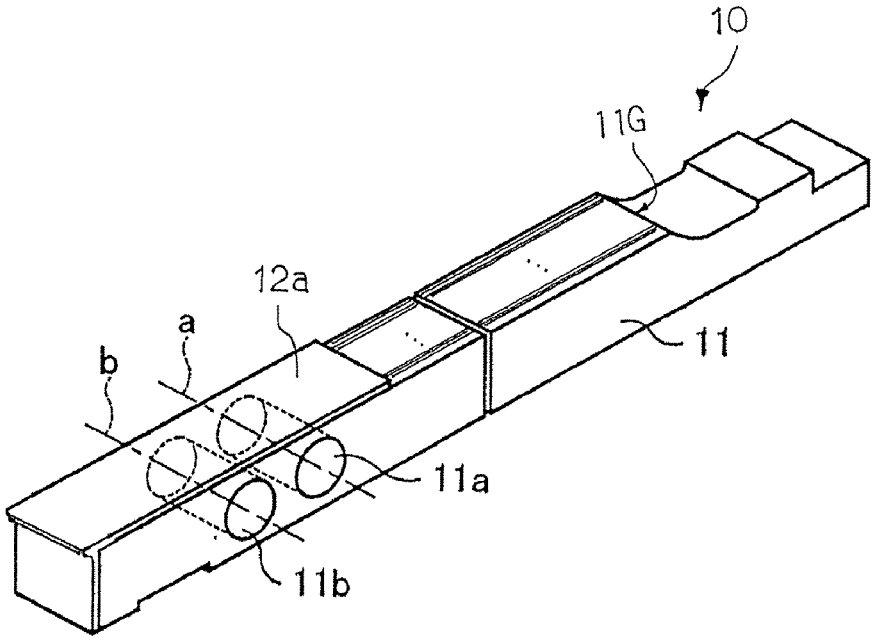
FIG. 3 is a perspective view showing holes formed in the front portion of the key.

Referring to FIG. 2 of the drawings, the first sort of the balancers 12*c* is embedded in the key 11. The wooden bar 11 has a generally rectangular parallelepiped configuration, and the covering plate 12*a* extends from the upper surface of the front portion to the front end. The grain of wood 11G extends in parallel to the longitudinal direction of the wooden bar. As will be better seen in FIG. 3, holes 11*a* and 11*b* are formed in the front portion of the wooden bar 11, and are spaced from each other in the longitudinal direction of the wooden bar 11. The holes 11*a* and 11*b* are cylindrical, and center axes of the holes 11*a* and 11*b* are labeled with "a" and "b", respectively. The center axes a and b cross the longitudinal direction of the wooden bar 11 at right angle. The hole 11*a* is approximately equal in dimensions to the other hole 11*b*, and the holes 11*a* and 11*b* straightly extend in the lateral direction of the wooden bar 11 without any change of the diameter. The holes 11*a* and 11*b* are open to the outside on both side surfaces of the wooden bar 11 so that the length of the holes 11*a* and 11*b* is equal to the width of the wooden bar 11. The balancers 12*c* are maintained in the holes 11*a* and 11*b* in stable, and are slightly retracted from the side surfaces of the wooden bar 11 as will be seen in FIG. 2. As described hereinafter in detail, although both end portions of the balancers 12*c* are approximately equal in diameter to the holes 11*a* and 11*b*, the balancers 12*c* partially bulge at intermediate portions thereof, and the intermediate portions are pressed to the inner surfaces defining the holes 11*a* and 11*b*.

Figure 4:
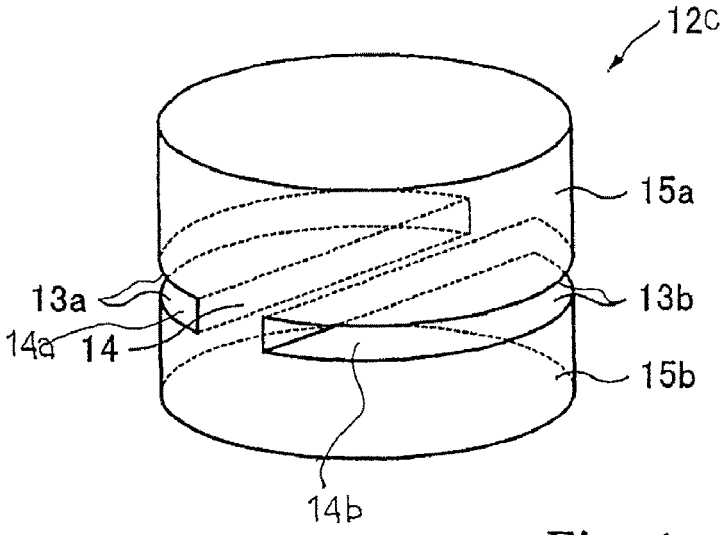
FIG. 4 is a perspective view showing the configuration of a balancer before insertion into the key.
Figure 5A:
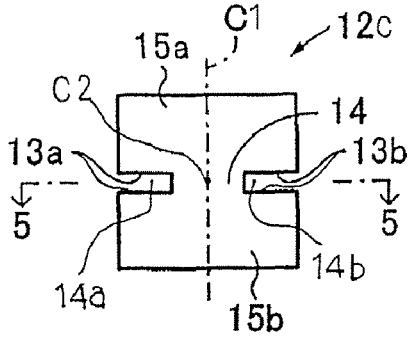
FIG. 5A is a front view showing the balancer.
Figure 5B:
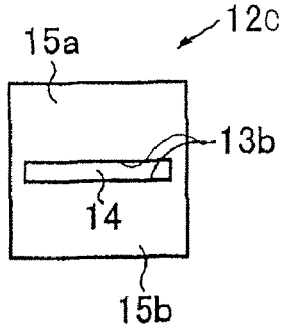
FIG. 5B is a side view showing the balancer.

FIGS. 4, 5A and 5B show the balancer 12*c* before insertion into the hole 11*a* or 11*b*. The balancers 12*c* are made of copper. However, alloy, sintered metal or composite material between metal and synthetic resin is available for the balancers 12*c*. Although the heavy metal is desirable, lead is to be avoided from the viewpoint of the environmental contamination. The balancers 12*c* may be made of iron, copper, brass or tungsten.

Figure 6:
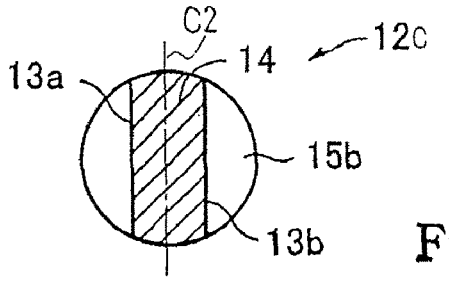
FIG. 6 is a cross sectional view taken along dots-and-dash line 5 and showing a crushable portion of the balancer.

The balancer 12*c* is broken down into disk portions 15*a* and 15*b* and a crushable portion 14 between the disk portions 15*a* and 15*b*. The disk portions 15*a* and 15*b* and crushable portion 14 are monolithic in this instance, and, accordingly, are made of one of the above-mentioned sorts of material. The disk portions 15*a* and 15*b* are approximately equal in diameter to the holes 11*a* and 11*b*, or the diameters of the disk portions 15*a* and 15*b* are slightly less than the diameters of the holes 11*a* and 11*b*. The crushable portion 14 has the width less than the diameter of the disk portions 15*a* and 15*b* so that the disk portions 15*a* and 15*b* are spaced from each other by the crushable portion 14. The disk portions 15*a* and 15*b* have respective left inner surfaces 13*a* and right inner surfaces 13*b*, and the left and right inner surfaces 13*a* and 13*b* of the disk portion 15*a* are respectively opposed to the left and right inner surfaces 13*a* and 13*b* of the disk portion 15*b* through hollow spaces 14*a* and 14*b*. The center axis of each balancer 15*a* or 15*b* is labeled with "C1" in FIG. 5A, and the center axis of the crushable portion 14 which crosses the center axis C1 at right angle is labeled with "C2" in the same figure. The hollow space 14*a* is symmetrical with the other hollow space 14*b*. As shown in FIG. 6, the crushable portion 14 has rounded end surfaces, and the rounded end surfaces are smoothly continued to the peripheral surfaces of the disk portions 15*a* and 15*b*.

Figure 7A:
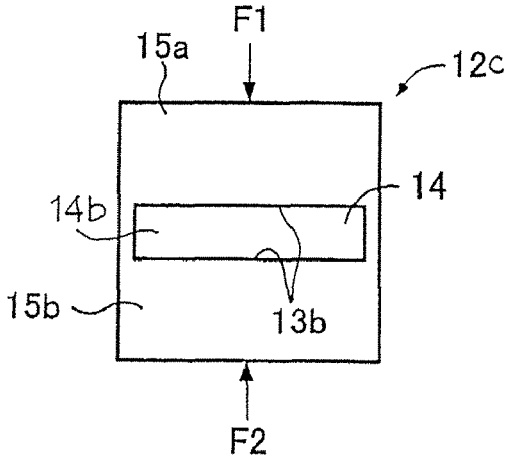
FIGS. 7A and 7B are side views showing a method for assembling the balancer with the key.

The balancers 12*c* are secured to the wooden bar 11 as follows. Firstly, the assembling worker aligns the center axes C1 of the balancers 12*c* with the center axes "a" and "b" of the holes 11*a* and 11*b*, and inserts the balancers 12*c* shown in FIGS. 4 to 6 into the holes 11*a* and 11*b* in such a manner that the center axes C2 extend in parallel to the longitudinal direction of the wooden bar 11, respectively. Subsequently, the assembling worker exerts force F1/F2 on both end surfaces of the balancers 12*c* as shown in FIG. 7A. The assembling worker may use a punch, a die and a hammer. The assembling worker lays the wood bar 11 on the die, and inserts the balancers 12*c* into the holes 11*a* and 11*b*. Then, the end surfaces of the balancers 12*c* are brought into contact with the surface of the die. Subsequently, the assembling worker brings the punch onto the other end surfaces of the balancers 12*c*, and strikes the punch with the hammer.

Figure 7B:
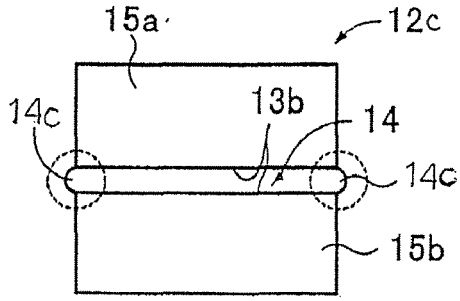

Then, the crushable portions 14 are plastically deformed or crushed so as to bulge as indicated by 14*c* in FIG. 7B. The hollow spaces 14*a* and 14*b* may be left between the right inner surfaces 13*a* and between the left inner surfaces 13*b*. However, the gaps between the inner surfaces 13*a* and 13*b* are reduced. The bulge portions 14*c* radially project from the peripheral surfaces of the disk portions 15*a* and 15*b*, and bite into the inner surface portions of the wooden bar 11. As a result, the balancers 12*c* are secured to the wooden bar 11. Since the bulge portions 14*c* make the inner surface portions of the wood bar 11 permanently deformed, the balancers 12*c* are not dropped out from the holes 11*a* and 11*b*.

As described in conjunction with the wooden bar 11, the grain 11G extends in parallel to the longitudinal direction of the wooden bar 11, and the intermediate portions 14*c* project in the direction in which the grain of wood 11G extends. For this reason, the wooden bar 11 is not cracked The monolithic balancers 12*c* are economically mass-produced so that the production cost of the keys 4 and 10 is drastically reduced. Moreover, the assembling worker is expected only to exert the force F1/F2 on both end surfaces of the balancer 12*c* so that the assembling work is simple. This also reduces the production cost of the keys 4 and 10.

Modifications of the First Embodiment

Figure 8:
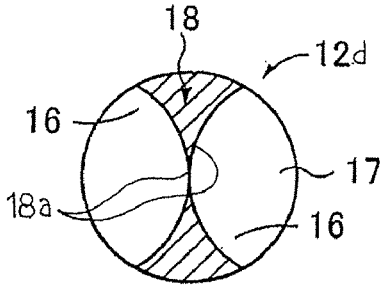
FIG. 8 is a cross sectional view showing the first modification of the balancer incorporated in the first embodiment.

FIG. 8 shows a cross section of the first modification 12*d* of the balancer 12*c*. The cross section is viewed in the direction same as that for the cross section shown in FIG. 6. The balancer 12*d* is also broken down into a pair of disk portions 17 and a crushable portion 18. The pair of disk portions 17 is similar to that shown in FIG. 4, and the crushable portion 18 is constricted so that hollow spaces 16 take place on both sides of the crushable portion 18. The crushable portion 18 has side surfaces 18*a*, which are curved like an arc.

The balancer 12*d* is secured to the wooden bar 11 in a similar manner to the balancer 12*c*. When the assembling worker exerts the force F1/F2 on the disk portions 17, the crushable portion 18 projects outwardly, and bites into the wooden bar 11.

Figure 9:
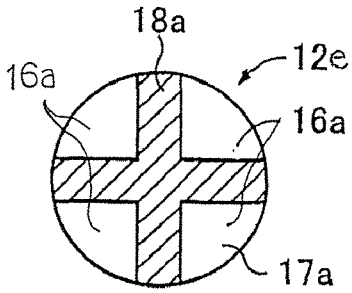
FIG. 9 is a cross sectional view showing the second modification of the balancer incorporated in the second embodiment.

FIG. 9 shows a cross section of the second modification 12*e* of the balancer 12*c*. The cross section is also viewed in the same direction as the cross sections shown in FIGS. 6 and 8. The balancer 12*e* is also broken down into a pair of disk portions 17*a* and a crushable portion 18*a*. The crushable portion 18*a* has a cross section like a cross so that four sector hollow spaces 16*a* take place take place.

The balancer 12*e* is secured to the wooden bar 11 as similar to the balancers 12*c* and 12*d*. When the assembling worker exerts the force F1/F2 on the disk portions 17*a*, the crushable portion 18*a* outwardly projects from the four ends, and bites into the wooden bar 11.

Figure 10:
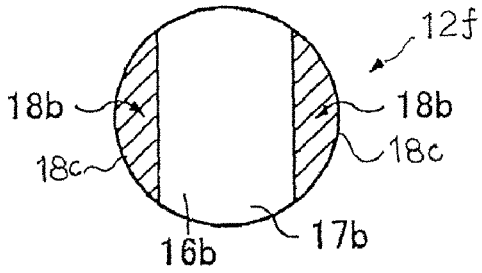
FIG. 10 is a cross sectional view showing the third modification of the balancer incorporated in the third embodiment.

FIG. 10 shows a cross section of the third modification 12*f* of the balancer 12*c*. The balancer 12*f* is also broken down into a pair of disks 17*b* and a pair of crushable portions 18*b*. The crushable portions 18*b* are spaced from each other so that a hollow space 16*b* takes place therebetween. In other words, the crushable portions 18*b* occupy the hollow spaces 14*a* and 14*b*, and the hollow space 17*b* takes place the zone assigned to the crushable portion 14. However, the hollow space 17*b* is wider than the crushable portion 14.

The balancer 12*f* is secured to the wooden bar 11 as similar to the balancer 12*c*. When the force F1/F2 is exerted on the disk portions 17*b*, the curved surfaces outwardly project, and bite into the wooden bar 11.

Figure 11B:
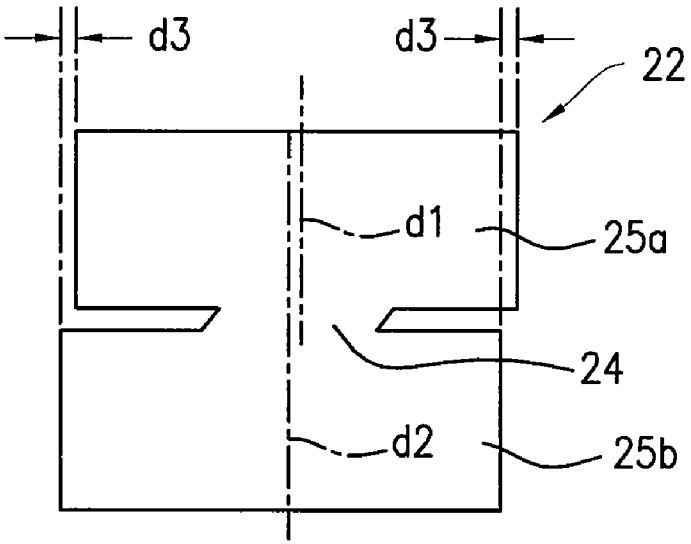
FIGS. 11A and 11B are side views showing the fourth modification of the balancer before and after force is exerted thereon.
Figure 11A:
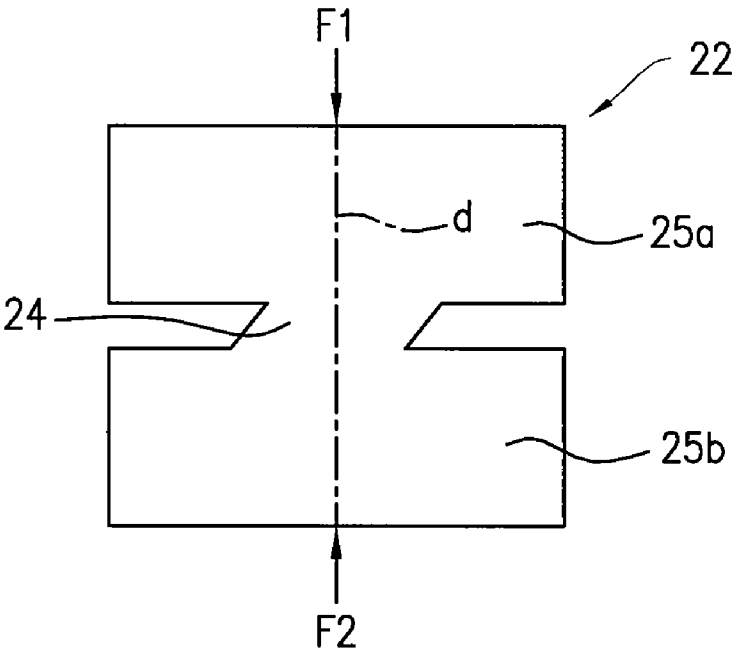

FIGS. 11A and 11B shows the fourth modification 22 of the balancer 12*c*. The balancer 22 is broken down into a pair of disks 23*a* and 25*b* and a crushable portion 24. The boundary between the crushable portion 24 and the disk portion 25*a* is deviated from the central area of the disk portion 25*a* toward one side of the balancer 22, and the boundary between the crushable portion 24 and the other disk portion 25*b* is deviated from the central area of the disk portion 25*b* toward the other side of the balancer 22. However, if the balancer 22 is cut along the line same as that in FIG. 6, the cross sectional view of the balancer 22 is same as that of the balancer 12*c*.

Before insertion into the wooden bar 11, the center axis of the disk portion 25*a* is coincident with the center axis of the other disk portion 25*b* as indicated by a dot-and-dash line d, and, accordingly, the peripheral surface of the disk portion 25*a* is contiguous to the peripheral surface of the other disk portion 25*b* without any step as shown in FIG. 11A.

When the assembling worker exerts the force F1/F2 on the disk portions 25*a* and 25*b*, the crushable portion 24 is crushed and further inclined toward the right side of the balancer shown in FIG. 11B. In other words, the disk portions 25*a* and 25*b* are sideward slipped from the crushable portion 24, and the center axis d1 of the disk portion 25*a* is deviated from the center axis d2 of the other disk portion 25*b*. Thus, the disk portion 25*a* rightward projects from the crushable portion 24 by d3, and the other disk portion 25*b* leftward projects from the crushable portion 24 by d3. The disk portions 25*a* and 25*b* give rise to plastic deformation in inner surface portions of the wooden bar 11, and bite into the wooden bar 11.

Figure 12A:
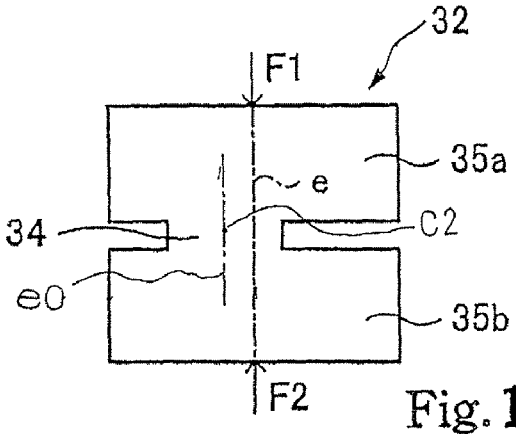
FIGS. 12A and 12B are side views showing the fifth modification of the balancer before and after force is exerted thereon.
Figure 12B:
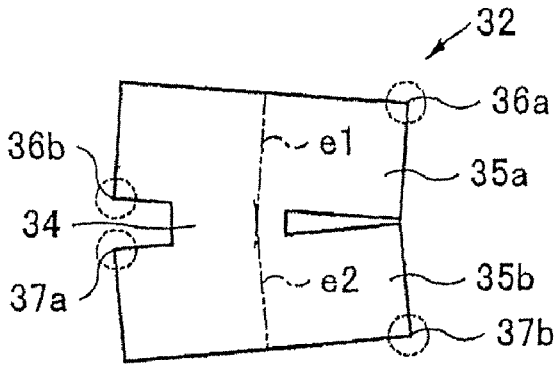
Figure 13:
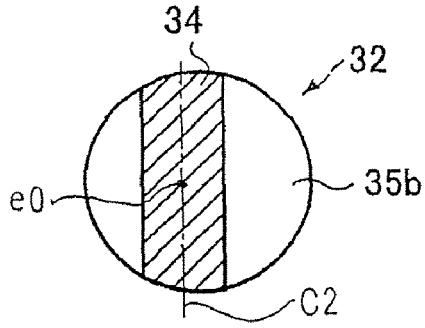
FIG. 13 is a cross sectional view showing a relative portion of a crushable portion with respect to a disk portion in the fifth modification.

FIGS. 12A and 12B show the fifth modification 32 of the balancer 12*c*. The balancer 32 is also broken down into a pair of disk portions 35*a* and 35*b* and a crushable portion 34. The disk portions 35*a* and 35*b* and crushable portion 34 are similar in configuration to the disk portions 15*a* and 15*b* and crushable portion 14, respectively. However, a vertical line e0, which crosses the center axis C2 at right angle, is offset from the center axes e of the disk portions 35*a* and 35*b* as shown in FIGS. 12A and 13. In other words, the right portions of the disk portions 35*a* and 35*b* are larger than the left portions.

When the assembling worker exerts the force F1/F2 on the disk portions 35*a* and 35*b*, the crushable portion 34 causes the disk portions 35*a* and 35*b* inclined, and the center axes e1 and e2 of the desk portions 35*a* and 35*b* are made crossing each other as shown in FIG. 12B. As a result, parts 36*a* and 37*b* of the circumferences of the outer end surfaces and parts 36*b* and 37*a* of the circumferences of the inner end surfaces project from the circumferences before the crush, and give rise to plastic deformation in the inner surface portions of the wooden bar 11. For this reason, the parts 36*a*, 36*b*, 37*a* and 37*b* bite into the wooden bar 11, and the balancers 32 are held in the wooden bar 11 in stable.

Figure 14A:
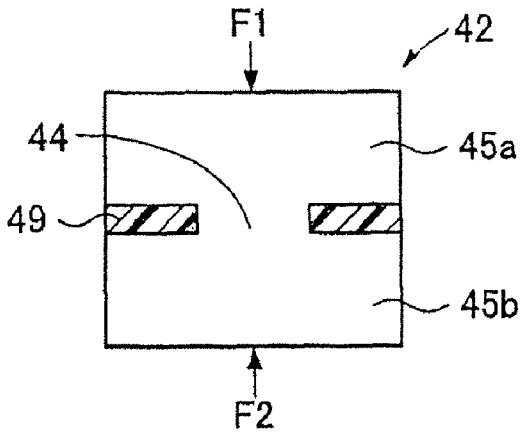
FIGS. 14A and 14B are side views showing the sixth modification of the balancer before and after force is exerted thereon.
Figure 14B:
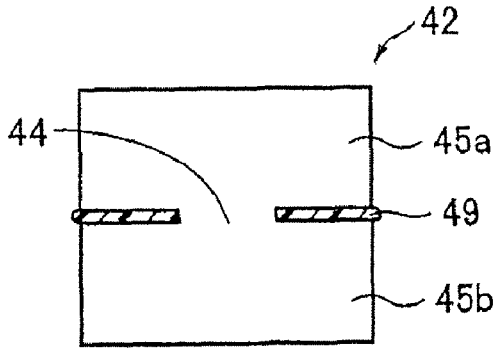

FIGS. 14*a* and 14*b* show the sixth modification 42 of the balancer 12*c*. The balancer 42 is also broken down into a pair of disk portions 45*a* and 45*b*, a crushable disk portion 44 and filler such as, for example, adhesive compound 49. In this instance, the crushable disk portion is concentric with the disk portions 45*a* and 45*b*. The crushable disk portion 44 is smaller in diameter than the disk portions 45*a* and 45*b* so that a hollow space takes place like a ring around the crushable disk portion 44. The hollow space is filled with the adhesive compound 49 as shown in FIG. 14A.

When the assembling worker exerts the force F1/F2 on the disk portions 45*a* and 45*b*, the crushable disk portion 44 is crushed so as to reduce the volume of the ring space. Then, the adhesive compound is pushed out from the ring space as shown in FIG. 14B, and is spread over the boundary between the inner surface of the wooden bar 11 and the balancer 42. The adhesive compound is solidified, and the balancer 42 is adhered to the wooden bar 11.

As will be understood from the foregoing description, the balancers 12*c*, 12*d*, 12*e*, 12*f*, 22, 32 and 42 have the respective crushable portions 14, 18, 18*a*, 18*b*, 24, 34 and 44, and the crushable portions 14, 18, 18*a*, 18*b*, 24, 34 and 44 are plastically deformed in the holes 11*a* and 11*b* formed in the wooden bars 11 upon exerting the force F1/F2 on the disk portions 15*a*/15*b*, 17, 17*a*, 17*b*, 25*a*/25*b*, 35*a*/35*b* and 45*a*/45*b*. The crushed portion 14, 18, 18*a*, 18*b*, 24 and 34 give rise to the plastic deformation of the wooded bars 11, and bite thereinto. Otherwise, the crushed portion 44 evacuates the adhesive compound from the space into the boundary between the balancer 42 and the inner surface of the wooden bar 11. As a result, the balancers 12*c*, 12*d*, 12*e*, 12*f*, 22, 32 and 42 are held in the wooden bars 11 in stable, and are hardly dropped out against the aged deterioration of the wooden bars 11.

Second Embodiment

Figure 15:
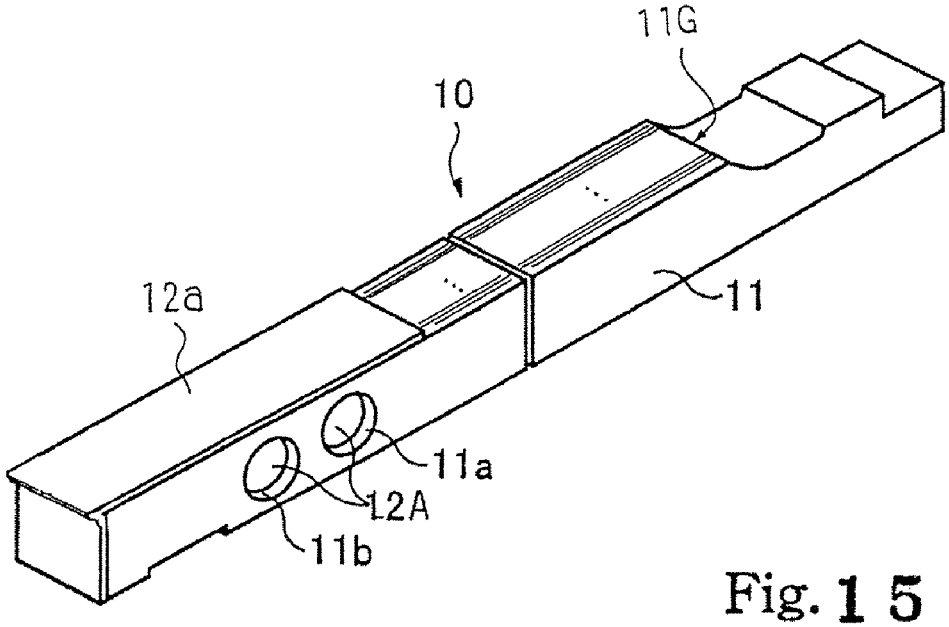
FIG. 15 is a perspective view showing another sort of balancers in the wooden bar implementing the second embodiment.
Figure 16:
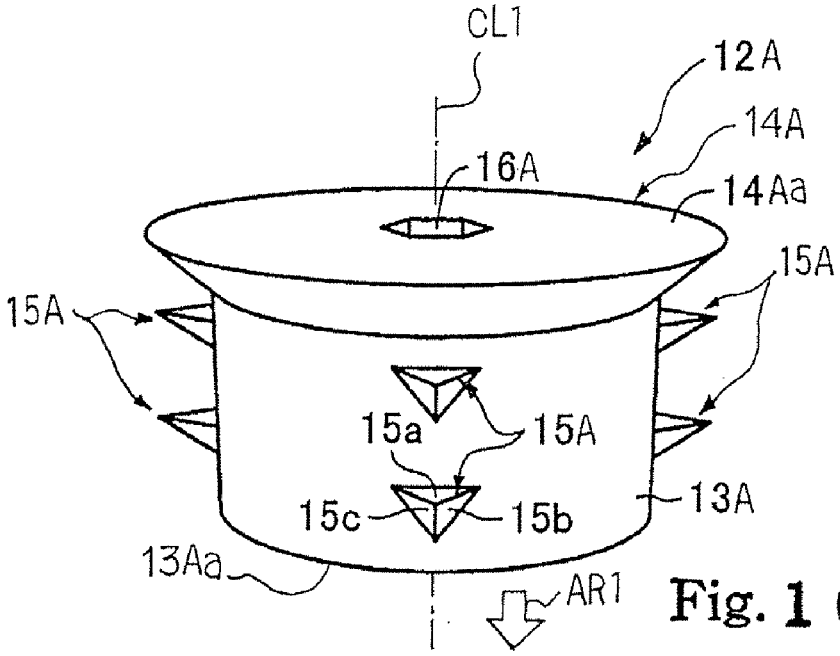
FIG. 16 is a perspective view showing the configuration of the balancer.

Referring to FIG. 15 of the drawings, balancers 12A are inserted into the holes 11*a* and 11*b* formed in the front portion of the white key 10. The balancers 12A are spaced from one another in the longitudinal direction of the wooden bar 11.

The balancer 12A is monolithic. However, the balancer 12A is broken down into a stem portion 13A, a head portion 14A and thorns 15A. In this instance, the balancers 12A are made of copper. However, iron, brass, tungsten, sintered metal or composite material between metal powder and synthetic resin are available for the balancers 12A. Although heavy metal is desirable, lead is to be avoided because of the environmental contamination.

The stem portion 13A is shaped into a column, and the head portion 14A, which is shaped into a frustum of cone, is formed on one end surface of the stem portion 13A. The stem portion 13A is roughly equal in diameter to the hole 11*a*/11*b*. The head portion 14A is equal in diameter at the narrow end to the stem portion 13A, and is larger in diameter at the wide end than the stem portion 13A. For this reason, the head portion 14A radially projects from the stem portion 13A, and a hexagonal socket 16A is open to the outside on the wide end surface 14Aa of the head portion 14A. Four pairs of thorns 15A project form the peripheral surface of the stem portions 13A. The pairs of thorns 15A are spaced from adjacent two pairs of thorns 15A by 90 degrees, and the thorns 15*a* of each pair are spaced in the direction parallel to the center axis CL1 of the balancer 12A.

Each of the thorns 15A is shaped into a small pyramid, and has a rear surface 15*a* substantially in parallel to the wide end surface 14Aa, and remaining two surfaces 15*b* and 15*c* form a sharp ridge. The sharp ridge is directed to the other end surface 13Aa so that the thorns 15A are cut into the wooden bar 11 while the balancer 12A is advancing in the direction indicated by arrow AR1.

Figure 17A:
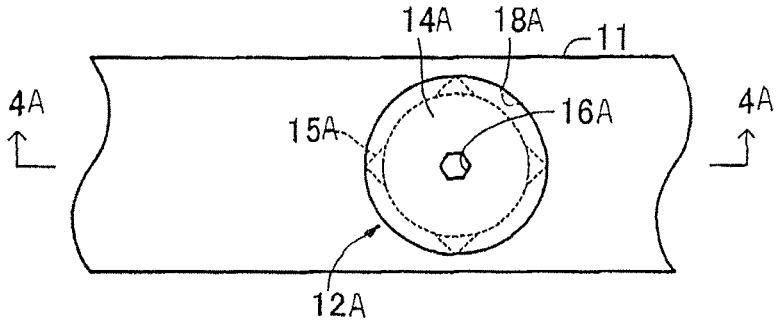
FIG. 17A is a side view showing the balancer inserted into the wooden bar at the first step of a method for securing the balancer to a wooden bar.
Figure 17B:
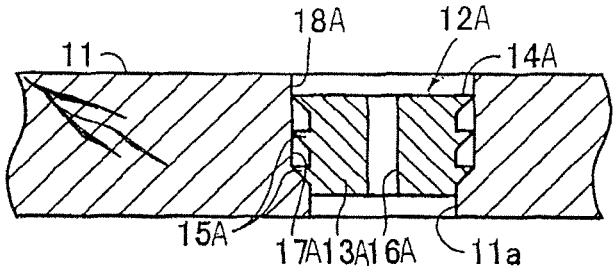
FIG. 17B is a cross sectional view taken along line 4A-4A of FIG. 17A and showing the balancer inserted into the wooden bar.

The balancers 12A are secured to the wooden bar 11 as follows. First, an assembling worker aligns the center axis CL1 with the center axis "a" or "b", and pushes the balancer 12A into the hole 11*a* or 11*b*. The assembling worker may use a punch and a hammer. The assembling worker brings the chip of the punch into contact with the head 14A, and strikes the punch with the hammer. Then, the balancer 12A advances into the hole 11*a* or 11*b*, and the thorns 15A cut their way into the wooden bar 11. As a result, four grooves 17A are left in the wooden bar 11 as shown in FIGS. 17A and 17B, and the head portion 14A bores up the hole 11*a* or 11*b* as indicated by 18A.

Figure 17C:
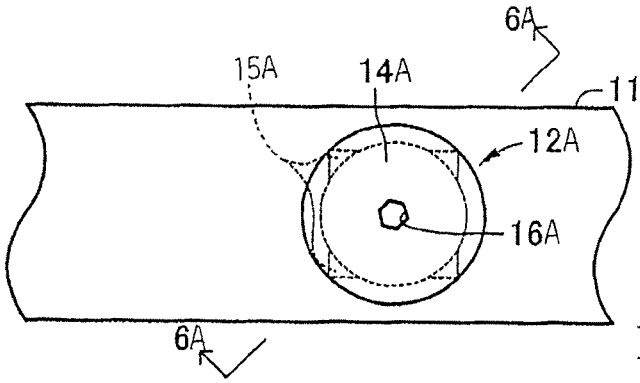
FIG. 17C is a side view showing the balancer rotated in the wooden bar at the second step of the method.
Figure 17D:
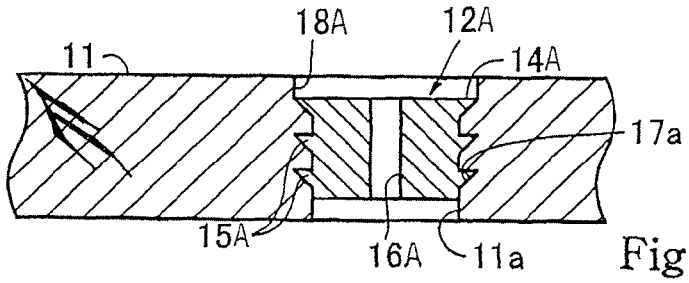
FIG. 17D is a cross sectional view taken along line 6A-6A of FIG. 17C and showing the balancer in the wooden bar.

Subsequently, the assembling worker inserts a hexagonal wrench into the hexagonal socket 16A, and turns the balancer 12A about the center axis CL1 at 45 degrees. The thorns 15A further cuts their way into the wooden bar 11, and arched grooves 17*a* are formed in parallel to the peripheral surface of the stem portion 13A as shown in FIGS. 17C and 17D. The surfaces 15*a* are held in contact with the inner surfaces defining the arched grooves 17*a*. In this situation, even if force is backward exerted on the balancer 12A, the thorns 15A are caught by the wood, and the balancer 12A is hardly dropped off from the hole 11*a* or 11*b*. If, on the other hand, the force is forwardly exerted on the balancer 12A, the balancer 12A does not advance in so far as the force is equal to or greater than the force exerted thereon during the insertion. As a result, the balancers 12A are maintained in the wooden bar 11 in stable, and are hardly dropped off therefrom.

As will be understood from the foregoing description, the balancers 12A are rotated after insertion into the holes 11*a* and 11*b* so that the thorns 15A swerve from the grooves 17A. The inner surfaces, which defined the arched grooves 17*a*, are closely held in contact with the thorns 15A, and do not permit the thorns 15A to move rearwardly. The method for assembling the balancers 12A with the wooden bars 11 is only different from the prior art method in that the assembling worker only turns the balancers 12A. The method makes the assembling work simple and easy so that the production cost for the black and white keys 4 and 10 is drastically reduced. Since the balancers 12A are monolithic, it is possible to mass product the balancers 12A, and any other additional part is not required. This is conducive to the reduction of cost.

Modifications of the Second Embodiment

Figure 18:
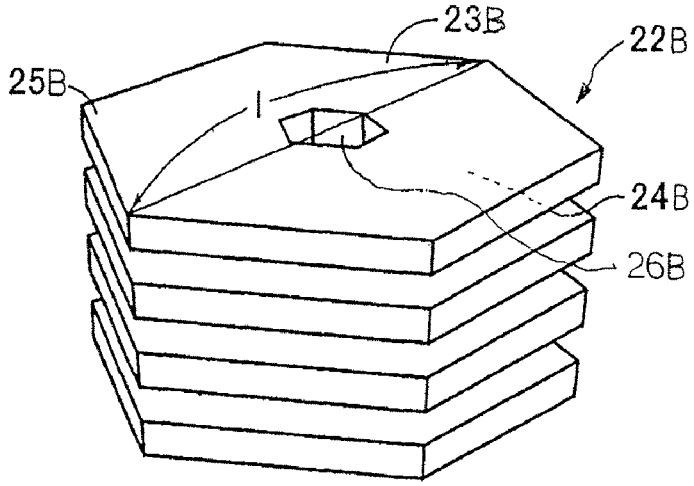
FIG. 18 is a perspective view showing a balancer to be secured to a wooden bar through the first modification of the method.

FIG. 18 shows a balancer 22B used in the black/white key 4 or 10. The balancer 22B is made of copper, and is broken down into plural hexagonal disk portions 23B and column portions 24B. Each of the hexagonal disk portions 23B has six edges 25B. The column portions 24B have the outer diameter less than the diagonal line 1 of the hexagonal disk portions 23B, and are inserted between the hexagonal disk portions 23B. Although the diagonal line 1 is longer than the diameter of the holes 11*a* and 11*b* formed in the wooden bar 11, it is possible to press the balancers 22B into the holes 11*a* and 11*b*. A hexagonal hole 26B is formed in the balancer 22B, and is open to the outsides on both end surfaces of the balancer 22B.

Figure 19A:
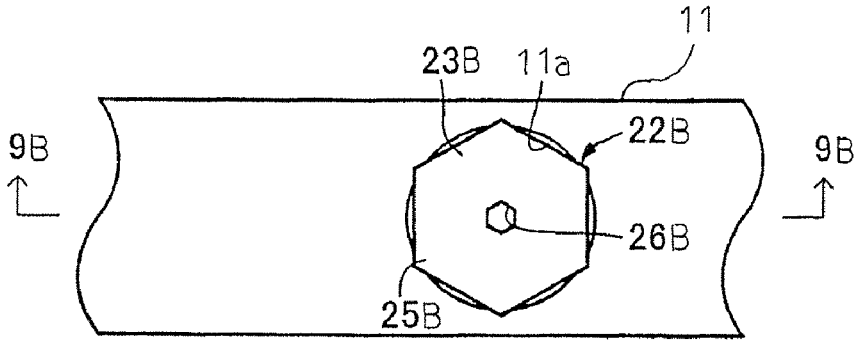
FIG. 19A is a side view showing the balancer inserted into the wooden bar at the first step of the first modification of the method.
Figure 19B:
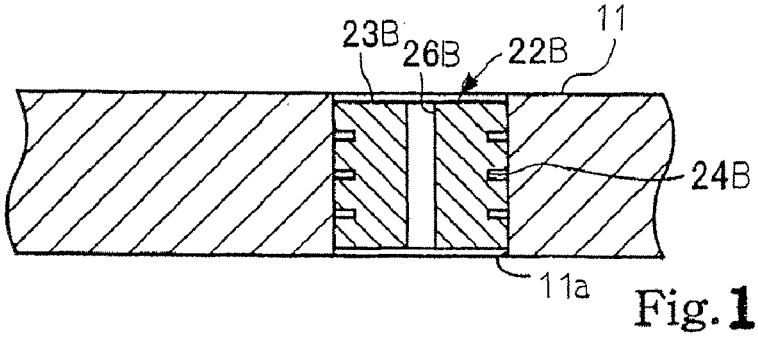
FIG. 19B is a cross sectional view taken along line 9B-9B of FIG. 19A and showing the balancer inserted into the wooden bar.

The balancer 22B is secured to the wooden bar 11 as follows. First, a worker aligns the center axis of the balancer 22B with the center axis "a" of the hole 11*a*, and brings a punch into contact with the hexagonal disk portion 23B. The worker strikes the punch with a hammer. The edges 25B cut their way into the wooden bar 11 so that the balancer 22B is pressed into the hole 11*a* as shown in FIGS. 19A and 19B. Six straight grooves are left in the wooden bar 11.

Figure 19C:
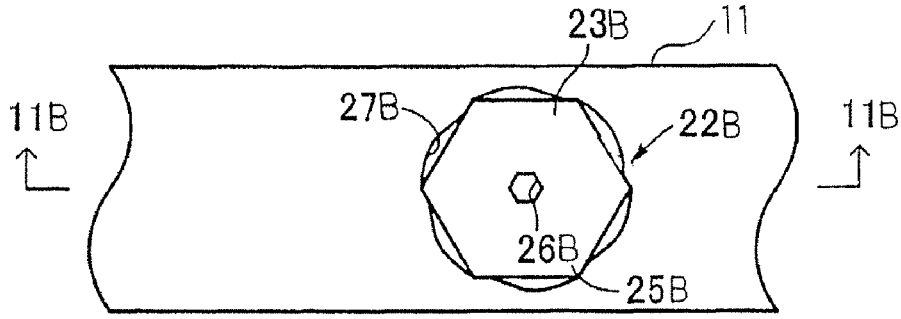
FIG. 19C is a side view showing the balancer rotated in the wooden bar at the second step of the first modification of the method.
Figure 19D:
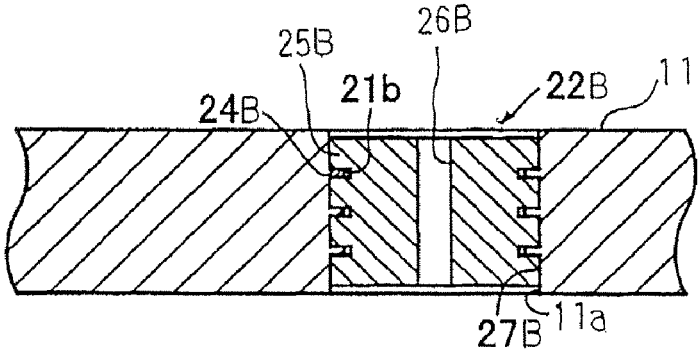
FIG. 19D is a cross sectional view taken along line 9B-9B of FIG. 19C and showing the balancer in the wooden bar.

Subsequently, the worker inserts a hexagonal wrench into the hexagonal hole 26B, and turns the balancer 22B in the hole 11*a* at 30 degrees as shown in FIGS. 19C and 19D. The edges 25B swerve from the straight grooves, and arched grooves are left in the wooden bar 11. If the edges 25B reach the adjacent straight grooves, the edges 25B become rearwardly movable in the adjacent straight grooves. In order to prevent the balancer 22B from the undesirable state, the rotation of the balancer 22B is to be less than 60 degrees. Even if force is exerted on the balancer 22B in the direction opposite to the direction of the insertion, the balancer 22B is hardly dropped off from the hole 11*a*, because the wood 21*b*, which separate the arched grooves from each other, resists the force.

Figure 20:
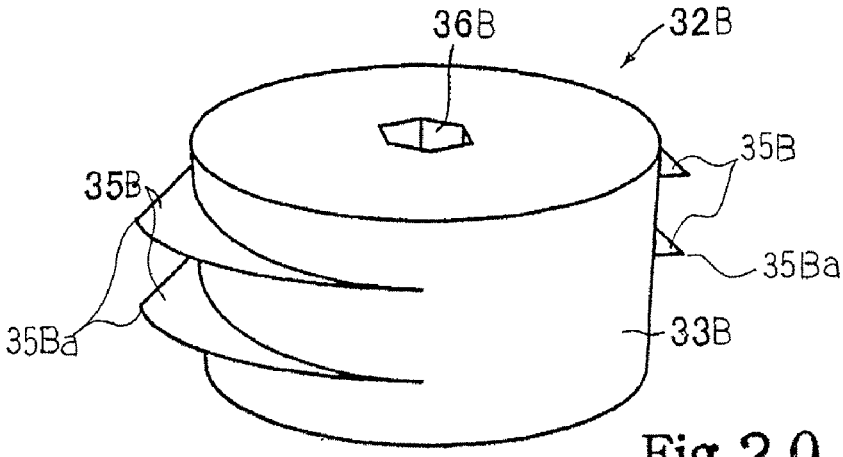
FIG. 20 is a perspective view showing a balancer to be secured to a wooden bar through the second modification of the method.

FIG. 20 shows another balancer 32B to be secured to the wooden bar 11. The balancer 32B is made of copper, and is broken down into a stem portion 33A and pairs of blades 35B. The pairs of blades 35B project from the peripheral surface of the stem portion 33B, and spirally extend in parallel to one another. The blades 35B of each pair are spaced from each other by 180 degrees. Thus, the pairs of blades 35B are like the turns of a screw partially cut away.

Each of the blades 35B increases the width in the clockwise direction. A hexagonal hole 36B is formed in the stem portion 33A, and is open to the outside on both end surfaces of the stem portion 33A.

The balancer is secured to the black/white key 4 or 10 as follows. Although the black/white key 4/10 includes the wooden bar 11 and covering plate 12*a* as similar to those shown in FIG. 15, the wooden bar 11 is formed with elliptical holes 31*a* instead of the circular holes 11*a* and 11*b*.

The major axis of the elliptical hole 31*a* is slightly shorter than the distance between the tips 35Ba of the blades 35B, and the minor axis is approximately equal to the diameter of the stem portion 33B.

Figure 21A:
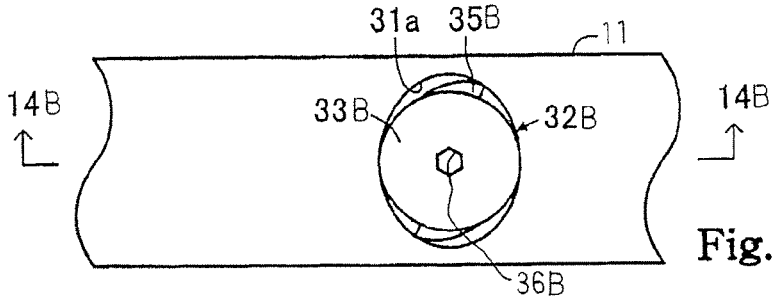
FIG. 21A is a side view showing the balancer inserted into the wooden bar at the first step of the second modification of the method.
Figure 21B:
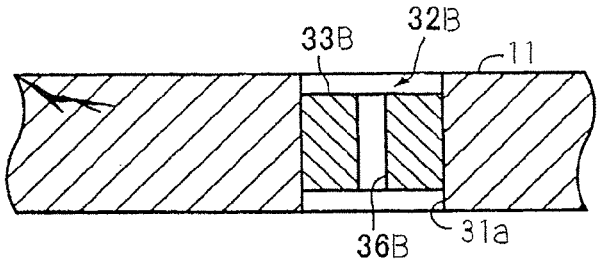
FIG. 21B is a cross sectional view taken along line 14B-14B of FIG. 21A and showing the balancer inserted into the wooden bar.

A worker secured the balancer 32B to the wooden bar 11 as follows. First, the worker aligns the balancer 32B with the elliptical hole 31*a*, and brings a punch into contact with the end surface of the stem portion 33B. The worker strikes the punch with a hammer. The blades 35B cut their way into the wooden bar 11, and the balancer 32B is pressed into the elliptical hole 31*a* as shown in FIGS. 21A and 21B.

Figure 21C:
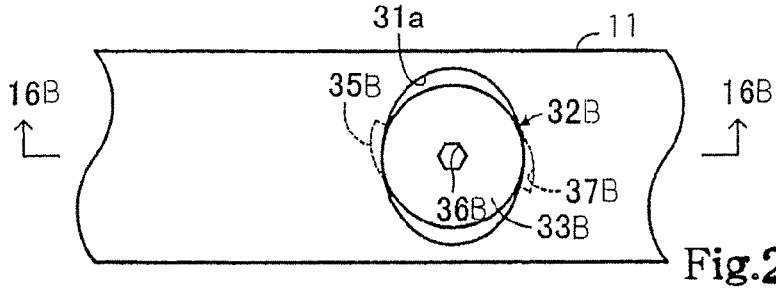
FIG. 21C is a side view showing the balancer rotated in the wooden bar at the second step of the second modification of the method.
Figure 21D:
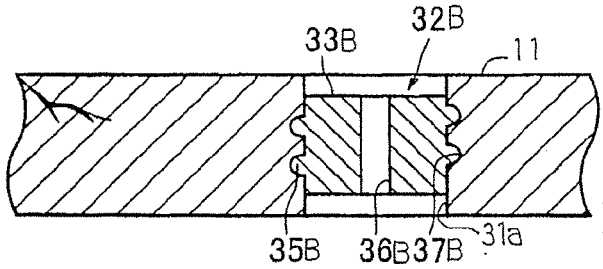
FIG. 21D is a cross sectional view taken along line 16B-16B of FIG. 21C and showing the balancer in the wooden bar.

Subsequently, the worker inserts a hexagonal wrench into the hexagonal hole 36B, and turns the balancer 32B with the hexagonal wrench. The blades 35B cut their ways into the wooden bar 11, and swerve from the elliptical hole 31*a*. Arched grooves 37B are left in the wooden bar as shown in FIGS. 21C and 21D, and the blades 35B are sandwiched between the inner wall portions of the wooden bar 11 which define the arched grooves 37B.

Even if force is exerted on the balancer 32B in the direction opposite to the direction of the insertion, the inner wall portions do not permit the balancer 35B to move rearwardly. Thus, the balancer 32B is maintained in the wooden bar 11 in stable.

Figure 22:
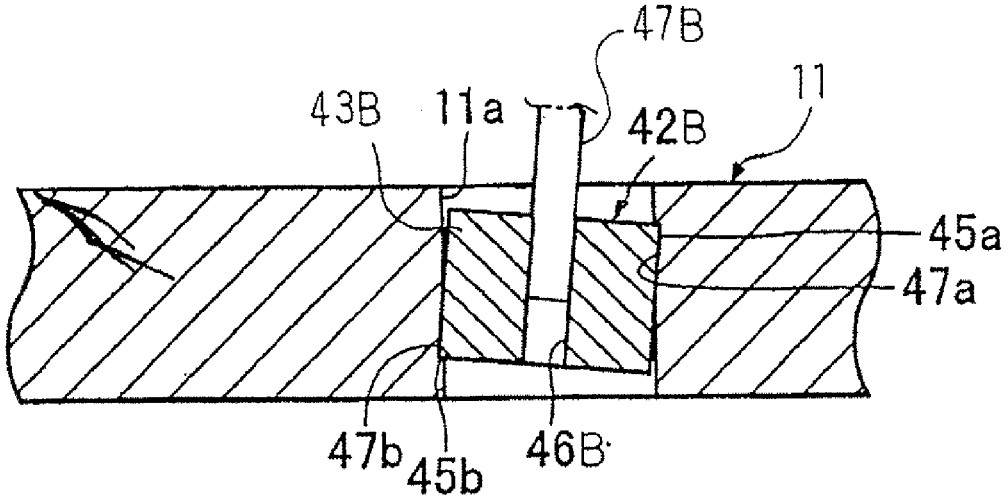
FIG. 22 is a cross sectional view showing another balancer in a wooden bar at an inclining step of the second modification of the method.

FIG. 22 shows a balancer 42B to be secured to the wooden bar 11 through the second modification of the method. The balancer 42B has a column body 43B, and the column body 43B is slightly smaller in value of the diameter than the hole 11*a* formed in the wooden bar 11. A cylindrical through-hole 46B is formed in the column body 43B, and is open to the outside on both end surfaces of the column body 43B.

The balancer 42B is secured to the wooden bar 11 as follows. First, a worker aligns the balancer 42B with the hole 11*a*, and presses the balancer 42B into the hole 11*a*. Subsequently, the worker inserts a bar 47B into the cylindrical through-hole 46B, and inclines the bar 47B to either side. Then, the balancer 42B is also inclined in the hole 11*a*, and bites into the wooden bar 11 at parts 45*a* and 45*b* of the circumferences of the end surfaces as shown. In other words, when the balancer 42B is inclined, the balancer 42B form dents 47*a* and 47*b* in the inner surface portion of the wooden bar 11, and the parts 45*a* and 45*b* of the circumferences are snugly received in the dents 47*a* and 47*b*.

Even if force is exerted on the balancer 42B in the direction of the insertion or the opposite direction, the dents 47*a* and 47*b* do not permit the balancer 42B to move. As a result, the balancer 42B is hardly dropped off from the hole 11*a*.

Moreover, the column body 42B is much simpler than the other balancers 22B and 32B, and the assembling work is easy as similar to those on the balancers 22B and 32B. Thus, the second modification is conducive to further reduction in production cost.

As will be understood, the balancers 12A, 22B, 32B and 42B are made only swerve from the access way into the wooded bar 11 in the method of the present invention. As a result, the balancers 12A, 22B, 32B and 42B bite into the wooden bars 11, and the wooden bars 11 resist the force undesirably exerted on the balancers 12A, 22B, 32B and 42B. This results in that the balancers 12A, 22B, 32B and 42B are maintained in the wooden bars 11 in stable against the aged deterioration of the wooden bars 11. The method is so simple that the production cost for the keys 4/10 is drastically reduced.

Third Embodiment

Figure 23:
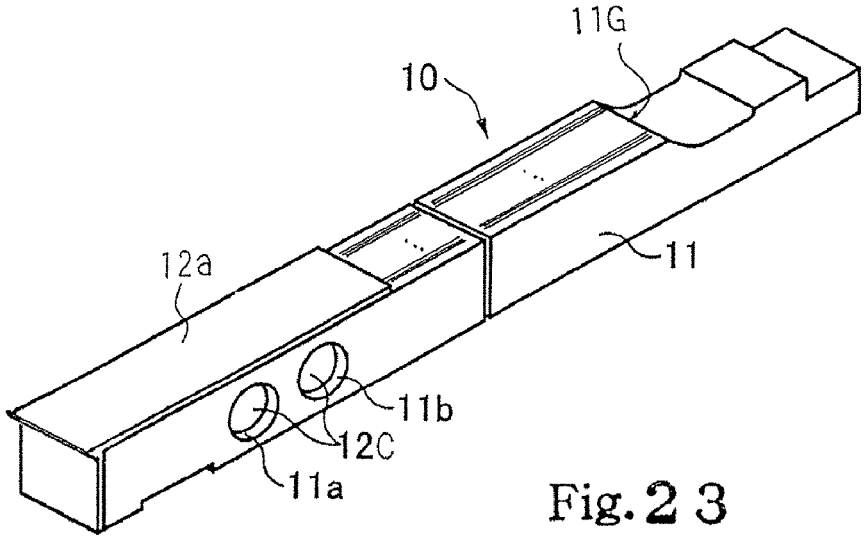
FIG. 23 is a perspective view showing the configuration of yet another sort of balancers in a wooden bar implementing the third embodiment.

FIG. 23 shows yet another sort of balancers 12C incorporated in the white key 10. The wooden bar 11 has the grain of wood 11G extending in the longitudinal direction of the wooden bar 11. In other words, the grain of wood 11G is laminated in the direction of the width of the wooden bar 11. The holes 11*a* and 11*b* are formed in the front portion of the wooden bar 11, and are cylindrical.

The balancer 12C is made of composite material such as, for example, tungsten powder containing synthetic resin, and is resiliently deformable. In this instance, the tungsten powder is dispersed in nylon. The amount of tungsten powder is so much that the tungsten powder containing nylon has a relatively large specific gravity. Even if the specific gravity is increased to 14, the tungsten powder containing nylon does not lose the resiliency.

Figure 24:
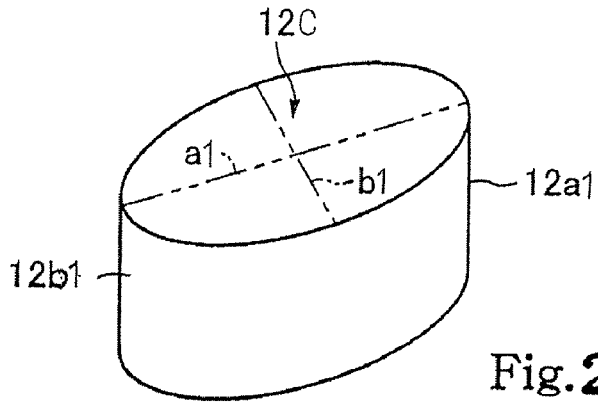
FIG. 24 is a perspective view showing the configuration of the balancer.

The balancer 12C is shaped into an elliptic cylinder as shown in FIG. 24. The major axis and minor axis are labeled with "a1" and "b1", respectively, and the diameter of the holes 11*a* and 11*b* is greater than the major axis a1 and is less than the minor axis b1.

Figure 25A:
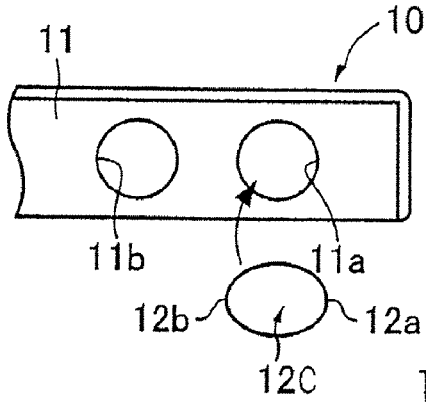
FIGS. 25A and 25B are side views showing a method for securing the balancer to the wooden bar.

The balancer 12C is secured to the wooden bar 11 as follows. A worker brings the balancer 12C close to the hole 11*a*, and directs the balancer 12C in such a manner as to have the major axis a1 in parallel to the longitudinal direction of the wooden bar 11 as shown in FIG. 25A. The worker exerts force on both end portions 12*a*1 and 12*b*1 at both ends of the major axis also as to make the balancer 12C shrunk in the direction of the major axis a1.

Figure 25B:
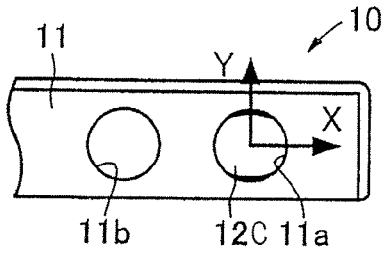

Subsequently, the worker aligns the shrunk balancer 12C with the hole 11*a*, and presses the shrunk balancer 12C into the hole 11*a* by striking it with a hammer. The resilient force is exerted on the inner surface of the wooden bar 11 in a direction X parallel to the longitudinal direction of the wooden bar 11 as shown in FIG. 25B. As described hereinbefore, the grain of wood 11G extends in parallel to the longitudinal direction of the wooden bar 11 so that the wooden bar 11 can well withstand the force in the direction X and the opposite direction. The balancer 12C does not exert any force in a direction of Y and the opposite direction on the inner surface of the wooden bar 11, or exerts only a negligible amount of force thereon, because the minor axis b1 is shorter than the diameter of the hole 11*a*. In these circumstances, the wooden bar 11 is hardly cracked by the balancer 12C.

As will be understood, the balancer 12C exerts the resilient force on the inner surface of the wooden bar 11 only in the direction X parallel to the longitudinal direction, and the force in the direction of Y is negligible. Since the wood well withstands the force in parallel to the grain 11G, the white key 10 is durable without any serious crack.

Modifications of the Third Embodiment

Figure 26:
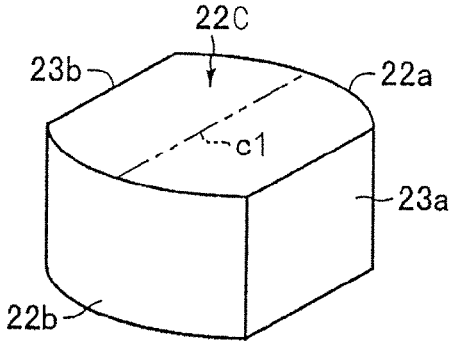
FIG. 26 is a perspective view showing the configuration of the first modification of the balancer.

FIG. 26 shows the first modification 22C of the balancer 12C. The balancer 22C is made of the composite material, and has a generally elliptic cylinder configuration without crescent portions at both ends of the minor axis. In other words, the balancer 22C has flat surfaces 23*a* and 23*b* extending between round surfaces 22*a* and 22*b* in parallel to the major axis c1.

Figure 27A:
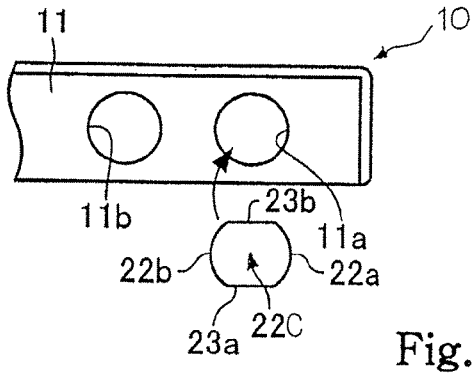
FIGS. 27A and 27B are side views showing a method for securing the first modification to the wooden bar.

The balancer 22C is secured to the wooden bar 11 as follows. First, a worker directs the balancer 22C in such a manner as to make the major axis in parallel to the longitudinal direction of the wooden bar 11 as shown in FIG. 27A, and exerts force on the round surfaces 22*a* and 22*b*. Then, the balancer 22C is shrunk in the direction of the major axis c1.

Figure 27B:
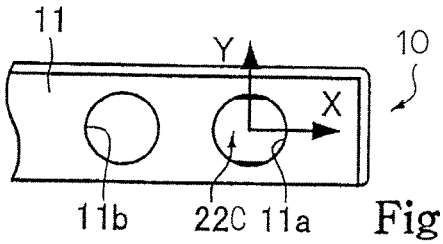

The worker aligns the shrunk balancer 22C with the hole 11*a*, and presses the shrunk balancer 22C into the hole 11*a* as shown in FIG. 27B. The shrunk balancer 22C exerts the resilient force on the inner surface of the wooden bar 11 in both directions parallel to the longitudinal direction of the wooden bar 11. The flat surfaces 23*a* and 23*b* are spaced from the inner surface of the wooden bar 11 so that the force in the vertical direction Y is negligible. Thus, the white key 10 is durable without any crack.

Fourth Embodiment

Figure 28:
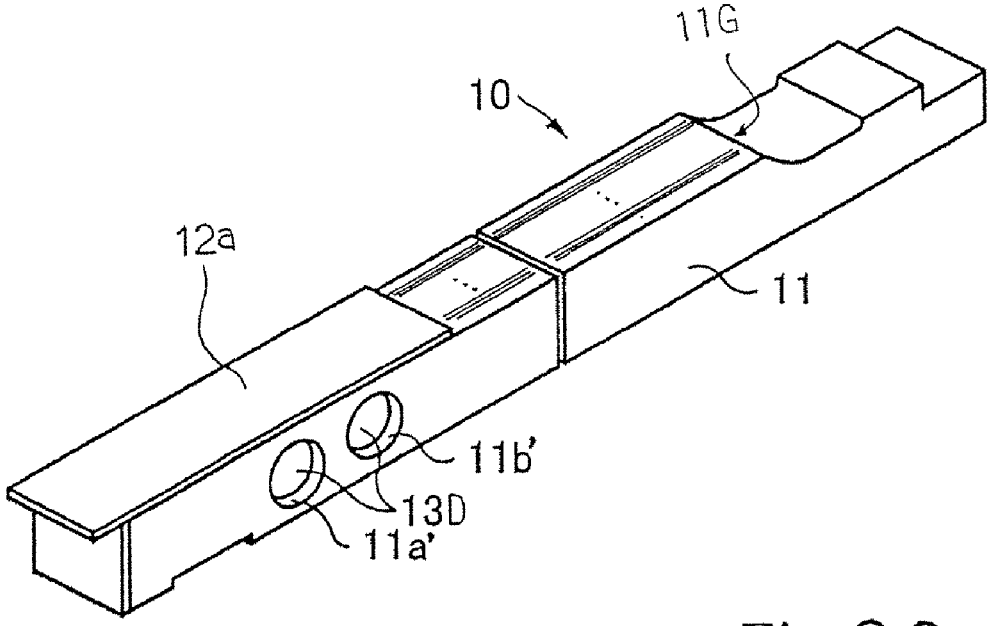
FIG. 28 is a perspective view showing the configuration of still another sort of balancers in a wooden bar implementing the fourth embodiment.

FIG. 28 shows still another sort of balancers 13D secured to the wooden bar 11 of the white key 10. The wooden bar has the grain of wood 11G, which extends in parallel to the longitudinal direction of the wooden bar 11. Holes 11*a*' and 11*b*' are formed in the front portion of the wooden bar 11, and have center axes extending in parallel to one another in the direction perpendicular to the longitudinal direction of the wooden bar 11. The holes 11*a*' and 11*b*' have circular cross sections, and the circular cross sections are varied in area in the direction of the center axes. In short, although the wooden bar 11 is formed with the holes 11*a*' and 11*b*' as similar to those for the first to third embodiments, the holes 11*a*' and 11*b*' are different in configuration from the holes 11*a* and 11*b*.

Figure 29:
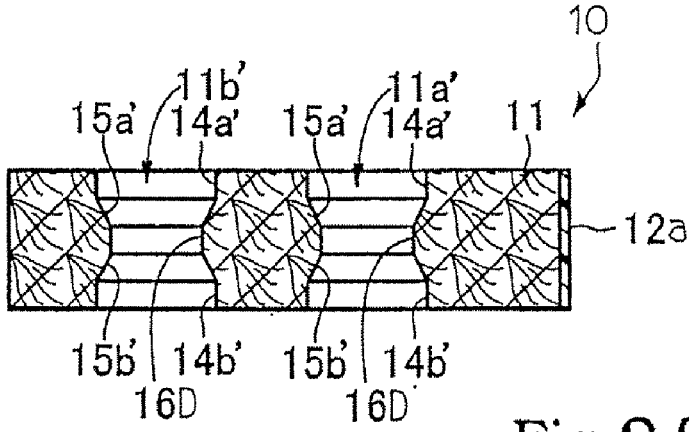
FIG. 29 is a cross sectional view showing constricted holes formed in the wooden bar.
Figure 30:
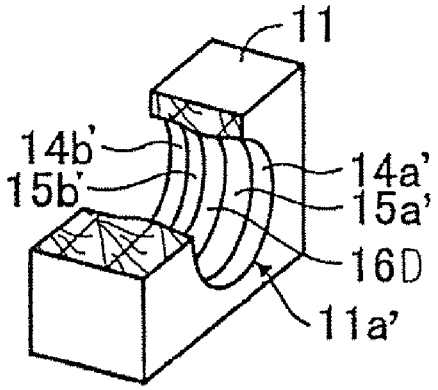
FIG. 30 is a partially cut-away perspective view showing a part of the wooden bar formed with the constricted hole.

As will be seen in FIGS. 29 and 30, the holes 11*a*' and 11*b*' are constricted in the middle. In detail, the entrances of the holes 11*a*/11*b* which are defined by inner surfaces 14*a*'/14*b*' are wider than central zones, which are defined by inner walls 16D. The entrances are connected to the central zones through intermediate zones, which are defined by slopes 15*a*'/15*b*'. The entrances and intermediate zones are arranged in symmetrical with respect to the central zone. Thus, the inner diameter of the holes 11*a*/11*b* is gradually reduced from the entrances to the central zones.

Figure 31:
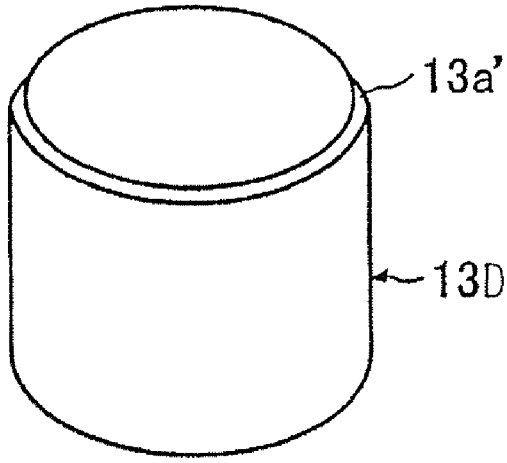
FIG. 31 is a perspective view showing the configuration of the balancer.

The balancer 13D is shown in FIG. 31. The balancer 13D is made of composite resilient material, which has a relatively large value in the specific gravity. In this instance, the composite resilient material is tungsten powder containing nylon, i.e., the tungsten powder is dispersed in the nylon. The balancer 13D has a generally column shape. The manufacturer can optimize the weight of the balancer 13D by changing the amount of tungsten powder. In fact, even if the specific gravity is increased to 14, the composite resilient material exhibits the resiliency.

Figure 32A:
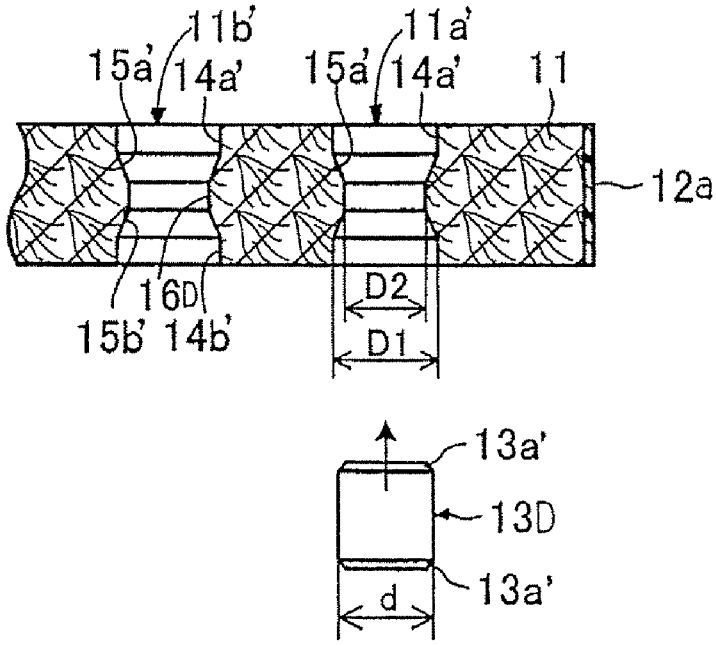
FIGS. 32A and 32B are cross sectional views showing a method for securing the balancer to the wooden bar.
Figure 32B:
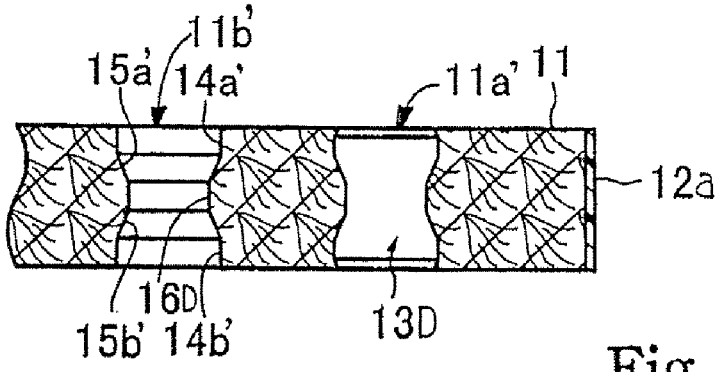

Although most of the peripheral surface extends in parallel to the center axis thereof, both ends are tapered as indicated by 13*a*'. The tapered surfaces are referred to as "guide portions 13*a*'". As shown in FIG. 32A, the balancer 13D has an outer diameter "d", and the entrances and central zone have inner diameters "D1" and "D2", respectively. The outer diameter d is equal to or less than inner diameter D1, and is greater than the inner diameter D2. The resiliency of the composite resilient material permits the balancers 13D to shrink the outer diameter from d to D2.

The balancers 13D are secured to the wooden bar 11 as follows. First, the worker aligns the balancer 13D with the hole 11*a*', and inserts the guide portion 13*a*' into the entrance. The worker can insert the balancer 13D into either entrance 14*a*' or 14*b*'. When the guide portion 13*a*' reaches the slope 15*a*', the worker feels the resistance against the insertion. Then, the worker presses the balancer 13D into the hole 11*a*'. The worker may strike the end surface of the balancer 13D with a hammer. The balancer 13D is resiliently deformed, and is moved into the central zone.

The worker further presses the balancer 13D into the hole 11*a*'. The balancer 13D is recovered to the initial shape after passing through the central zone. When the end portion reaches the other of the entrances 14*b*' or 14*a*', the worker stops to exert the force on the balancer 13D. The balancer 13D exerts the resilient force on the slopes 15*a*' and 15*b*' and inner surface 16D, and the resiliency keeps the balancer 13D hardly moved in the hole 11*a*'. Thus, the balancer 13D is secured to the wooden bar 11.

Even though the holes 11*a* and 11*b* are widened due to the aged deterioration, at least the central zone still has the inner diameter D2 less than the outer diameter d of the balancer 13D, and the balancer 13D continuously exerts the resilient force on at least the inner surface 16D. For this reason, the balancers are neither chattered in the holes 11*a*' and 11*b*' nor dropped off from the holes 11*a*' and 11*b*'.

As will be understood from the foregoing description, the constricted holes 11*a*' and 11*b*' make the balancers 13D partially shrunk, and the resiliency of the composite resilient material keeps the balancers 13D stable in the constricted holes 11*a*' and 11*b*' against the aged deterioration in the wooden bar 11.

Moreover, the worker is expected to exert the force on the balancers 13D in the direction of the center axes of the constricted holes 11*a*'/11*b*' for the insertion. Thus, the assembling work is simple, and the simple assembling work reduces the production cost of the black and white keys 4 and 10.

Modifications of the Fourth Embodiment

Figure 33:
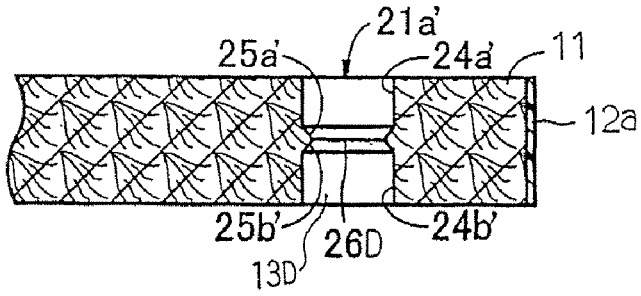
FIG. 33 is a cross sectional view showing the first modification of the balancer inserted into another constricted hole.
Figure 34:
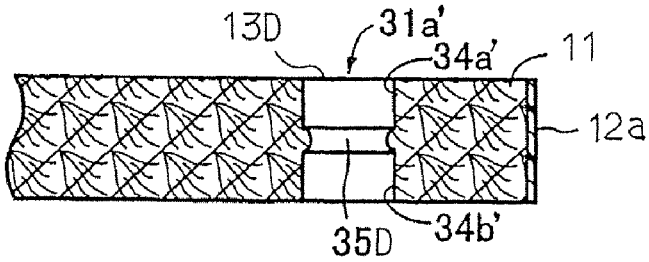
FIG. 34 is a cross sectional view showing the second modification of the balancer inserted into yet another constricted hole.

FIG. 33 shows the first modification 21*a*' of the constricted hole 11*a*'/11*b*'. The balancer 13D is inserted into 21*a*', and is resiliently deformed in conformity with the constricted hole 21*a*'.

The constricted hole 21*a*' has entrances 24*a*' and 24*b*', which are open to the outside on the side surfaces of the wooden bar 11. The entrances 24*a*' and 24*b*' are equal in diameter to and longer in length than the entrances 14*a*' and 14*b*'. A pair of slopes 25*a*'/25*b*' is formed between the entrances 24*a*' and 24*b*', and the slopes 25*a*'/25*b*' are symmetrical with each other. The slope 25*a*' makes the diameter of the hole 21*a*' from the entrance 24*a*' to the middle 26D of the hole 21*a*', and the slope 25*b*' makes the diameter of the hole 21*b*' from the other entrance 24*b*' to the middle 26D. For this reason, the diameter is minimized at the middle 26D of the hole 21*a*'. The slopes 25*a*'/25*b*' are shorter than the slopes 15*a*' and 15*b*', and the middle 26D is equal to the inner diameter of the central zone. For this reason, the slopes 25*a*'/25*b*' are sharply inclined rather than the slopes 15*a*' and 15*b*'.

The balancer 13D is secured to the wooden bar 11 as similar to the fourth embodiment, and no further description is hereinafter incorporated for the sake of simplicity. The first modification keeps the balancer 13D stable in the constricted hole 21*a*'. Moreover, the slopes 25*a*' and 25*b*' are so sharp that the wooden bar 11 strongly grasps the balancers 13D.

FIG. 24 shows the second modification 31*a*' of the constricted hole 11*a*'/11*b*'. The constricted hole 31*a*' has entrances 34*a*' and 34*b*', which are equal in length and diameter to the entrances 24*a*' and 24*b*', and a central zone 35D is sandwiched between the entrances 34*a*' and 34*b*'. The central zone is decreased in diameter from one of the entrances 34*a*' and 34*b*' to the middle of the central zone 35D, and is increased from the middle to the other of the entrances 34*a*' and 34*b*'. For this reason, the periphery of the central zone 35D is indicated by a hyperbolic curve on the longitudinal cross section. The middle of the central zone 35D is equal in diameter to the middle 26D of the central zone.

The balancer 13*d* is secured to the wooden bar 11 as similar to the fourth embodiment, and achieves all the advantages. Moreover, the gently curved central zone 35D permits the worker smoothly to insert the balancer 13D into the constricted hole 31*a*'.

Figure 35:
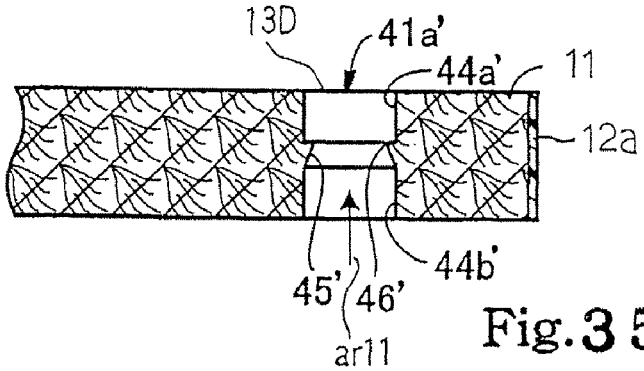
FIG. 35 is a cross sectional view showing the third modification of the balancer inserted into still another constricted hole.

FIG. 35 shows the third modification 41*a*' of the constricted hole 11*a*'/11*b*'. The constricted hole 41*a*' has both end portions 44*a*' and 44*b*', which are equal in diameter and length to the entrances 24*a*' and 24*b*'. The central zone is formed by only one slope 45' between the end portions 44*a*' and 44*b*'. The slope 45' makes the central zone decreased in diameter from the end portion 44*b*' to the other end portion 44*a*'. For this reason, the diameter is abruptly increased at the boundary between the central zone or slope 45' and the end portion 44*a*'. In other words, a stopper wall 44*b*' is formed at the boundary between the slope 45*a*' and the end portion 44*a*'. Thus, the constricted hole 41*a*' has the minimum diameter at the boundary between the central zone and the end portion 44*a*'. The minimum diameter is equal to the middle 26D of the central zone.

Since the diameter is abruptly increased at the boundary between the central zone or slope 45' and the end portion 44*a*', the worker is to insert the balancer 13D from the end portion 44*b*' as indicated by arrow ar11. The stopper wall 46' does not permit the balancer 13D to move in the direction opposite to the arrow ar11. Thus, the slope 45' allows the balancer 13D smoothly to enter the end portion 44*a*' as indicated by the arrow ar11, and prohibits it from the reverse motion.

As will be understood from the foregoing description, the fourth embodiment and modifications thereof keeps the balancers 13D stable in the constricted holes 11*a*'/11*b*', 21*a*', 31*a*' and 41*a*' against the aged deterioration of the wooden bar 11 without any complicated work in the assemblage.

Fifth Embodiment

Figure 36:
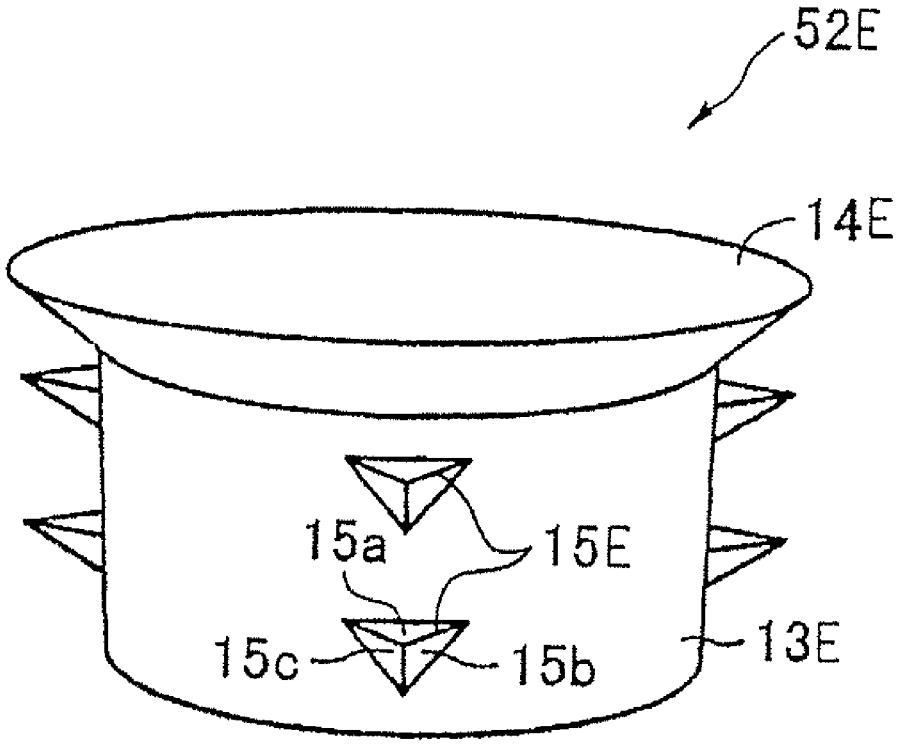
FIG. 36 is a perspective view showing the configuration of yet another sort of balancer implementing the fifth embodiment.

FIG. 36 shows yet another sort of balancer 52E to be secured to the keys 4 and 10. The balancer 53E is made of copper, and is broken down into a stem portion 13E, a head portion 14E and thorns 15E. The balancer 53E is similar in configuration to the balancer 12A except for the hexagonal hole 16A. Namely, neither hole nor recess is formed in the balancer 52E. The head portion 14E is greater in diameter than the holes 11*a*/11*b*, and the stem portion 13E is equal to or less in diameter than the holes 11*a*/11*b*.

The balancer 52E is secured to the wooden bar 11 as follows. First, a worker aligns the balancer 52E with the hole 11*a* or 11*b*, and presses it into the hole 11*a*/11*b*. The punch and hammer are available for the insertion. The thorns 15E form the grooves during the insertion as similar to the balancer 12A.

Subsequently, the worker pinches both end surfaces, which are exposed to the outside through both openings on the side surfaces of the wooden bar, with a suitable tool or jig, and turns the balancer 52E in the hole 11*a*/11*b*. The thorns 15E swerve from the grooves, and bite into the wooden bar 11.

The wooden bar 11 offers the resistance against the reverse motion of the balancer 5E. Thus, the thorns 15E, which bite into the wooden bar 11, prevent the balancer 52E from dropping off from the wooden bar 11.

Any tool or jig is available for the balancer 52E in so far as it makes the balancer 52E turn in the hole 11*a*/11*b*. A pair of resilient bars, which are held in contact with both ends, or a vacuum pincette may be used as the tool.

Modifications of the Fifth Embodiment

The first to third modifications of the fifth embodiment are similar to the modifications 22B, 32B and 42B except for the hexagonal holes 26B, 36B and 46B. Namely, any hole is not formed in the first to third modifications of the fifth embodiment. When the worker makes the edges 25B, blades 35B or part of peripheries swerve from the grooves, the worker pinches the first, second or third modification with the tool or jig, and turns the balancer.

Although particular embodiments of the present invention have been shown and described, it will be apparent to those skilled in the art that various changes and modifications may be made without departing from the spirit and scope of the present invention.

The grand piano does not set any limit to the technical scope of the present invention. The present invention is applicable to an upright piano or any keyboard musical instrument having keys embedded with balancers.

For example, a mute piano is an example of the keyboard musical instrument. A hammer stopper and an electronic tone generating system are installed in a piano. The hammer stopper is moved into or out of the trajectories of the hammers, and the electronic tone generating system monitors the keys for producing pieces of music data representative of the tones to be electronically produced. When a user wishes to practice the fingering without any acoustic piano tones, the user moves the hammer stopper into the trajectories of the hammers so that the hammers rebound on the hammer stopper before striking the strings. The user hears the electronic tones instead of the acoustic piano tones.

Another example is an automatic player piano, in which an automatic playing system is incorporated. The automatic playing system includes solenoid-operated key actuators under the keys, and makes the solenoid-operated key actuators to move the keys without fingering. Thus, the automatic playing system reproduces a piece of music without fingering on the keyboard.

Yet another example is a practice keyboard. While a user is fingering on the keyboard, an absorber is struck with the hammers or quasi-hammers so that the user practices the fingering without any tone.

The monolithic balancer 12*a* does not set any limit to the technical scope of the present invention. The crushable portions 14, 18, 18*a*, 18*b*, 24, 34 and 44 may be jointed to the disk portions 15*a*/15*b*/17, 17*a*, 17*b*, 25*a*/25*b*, 35*a*/35*b* and 45*a*/45*b*. This modification is referred to as a "composite balancer". In this instance, it is possible to make the crushable portion 14 of certain material more crushable than the material for the disk portions 15*a* and 15*b*. Moreover, the disk portions 15*a* and 15*b* may be larger in specific weight than the crushable portion 14. In this instance, it is desirable that the crushable portion 14 is assembled with the disk portions 15*a* and 15*b* for easiness of handling. The composite balancer is advantageous in that the crushable portions widely project and in that the disk portions are designed to be easily fitted into the holes.

The cylindrical holes 11*a*/11*b* and generally column-shaped balancers 12*c*, 12*d*, 12*e*, 12*f*, 22, 32 and 42 do not set any limit to the technical scope of the present invention. The holes 11*a*/11*b* may have a triangle cross section, a rectangular cross section, a polygonal cross section or an elliptical cross section, and, accordingly, the balancers may have the cross section corresponding to the holes.

The crushable concentric disk portion 44 does not set any limit to the technical scope of the present invention. The crushable portion of the balancer 42 may have the configuration same as any one of the other balancers 12*c*, 12*d*, 12*e*, 12*f*, 22 and 32. Moreover, the crushable disk portion may be offset from the disk portions 45*a*/45*b*.

The adhesive compound 49 does not set any limit to the technical scope of the present invention. The filler may be synthetic resin, rubber or soft metal.

The wooden bar 11 does not set any limit to the technical scope of the present invention. The black keys 4 and white keys 10 may be fabricated on the basis of synthetic bars instead of the wooden bars 11. In this instance, the manufacturer does not take the direction of grain 11G into account. The crushable portions are allowed to project in any direction.

In order to make the balancers 12A, 22B and 32B swerve from the straight grooves, the worker turns the balancers 12A, 22B and 32B in the holes 11*a*. However, the worker may slide the balancers 12A, 22B and 32B. Then, some thorns 15A, some edges 25B and some blades 35B bite into the wooden bar 11.

Thorns or claws may be formed on the end surfaces of the column body 43B. Otherwise, the circumferences may be partially recurved. The hexagonal disk portions 23B may be replaced with triangle disk portions, rectangular disk portions or pentagonal disk portions.

In the third embodiment and its modification, the elliptic cylindrical balancer 12C and generally elliptic cylindrical balancer 22*c* are pressed into the circular holes 11*a*. However, other combinations of the balancers and holes are available for the keys 4 and 10. The hole and balancer may be shaped in an elliptical cylinder and a circular column. Otherwise, a cubic balancer may be pressed into a rectangular parallelepiped hole. The keys may be formed with recesses instead of the holes 11*a* and 11*b*.

The tungsten power and nylon do not set any limit to the technical scope of the present invention. The composite material may be made from another sort of heavy metal powder and another sort of synthetic resin. Otherwise, a piece of solid metal may be wrapped with synthetic resin. However, the lead is to be avoided. For example, a column of heavy metal is wrapped with a sheet of metal powder containing synthetic resin, and the balancers 12C/22C may be replaced with this sort of balancers.

The composite resilient material may be made from another sort of heavy metal such as, for example, iron or copper and another sort of synthetic resin. Any combination is available for the balancer in so far as the composite material has the resiliency and large specific gravity.

Although the balancer 13D is monolithic, the monolithic body does not set any limit to the technical scope of the present invention. A modification of the balancer 13D may be constituted by a core, which is made of heavy metal, and an outer layer, which is made of resilient material such as, for example, synthetic resin or rubber. However, it is recommendable to avoid lead from the viewpoint of the environmental contamination. It is necessary that the outer layer has the thickness greater than the difference between the maximum diameter of the constricted hole and the minimum diameter thereof. The core is less in diameter than the minimum diameter of the constricted hole.

The constricted hole may have an elliptical cross section, a triangle cross section or a rectangular cross section. When the elliptic cylinders are formed in the wooden bar, it is desirable that the elliptical cylinders have the major axes extending in parallel to the grain of wood 11G.

The balancers 13D with the circular cross section do not set any limit to the technical scope of the present invention. The balancer may have a cross section corresponding to the constricted hole described in the previous paragraph. Moreover, a ring-shaped groove may be formed in the central portion of the column balancer 13D so as to receive the inner wall portion, which defines the central zone. A balancer, which is available for the keys 4 and 10 of the pre-sent invention, may have a diameter slightly greater than the diameter of the entrances in so far as the composite material permits the balancer to be widely deformed.

The entrances 14*a*'/14*b*', 24*a*'/24*b*' and 34*a*'/34*b*' are equal in diameter and length to each other in the fourth embodiment and its modifications. However, this feature does not set any limit to the technical scope of the present invention. In another modification, the entrances are different in diameter and/or length from one another.

The stem portion 13E may be less in diameter than the hole 11*a*/11*b* in so far as the thorns 15E have a radius of curvature greater than that of the hole 11*a*/11*b*.

In order to make the balancers 52E swerve from the straight grooves, the worker may slide the balancers 52E. The changes of the second embodiment are applicable to the fifth embodiment.

Claim languages are correlated with the component parts of the embodiments and modifications thereof as follows. The action units 5, hammers 6 and strings 8 as a whole constitute a "tone generator". The black keys 4 and white keys 10 serve as "plural keys", and the rear portions and front portions are corresponding to "end portions" and "other end portions", respectively. The wooden bars 11 are corresponding to "bars", and balance pins 3*b* offer "fulcrums" to the keys.

The bulge portion 14*c* and crushed portions 24, 34 and 44 are corresponding to a "plastically deformed portion", and make the balancers 12*c*, 12*d*, 12*e*, 22, 32 and 42 bite into the wooden bars 11 at the bulge portion 14*a*, part of the disk portion 25*a*, parts of circumferences 36*a*/36*b*/37*a*/37*b* and adhesive compound 49. The holes 11*a* and 11*b* serve as a "hollow space", and the pair of disk portions 15*a*/15*b*, 17, 17*a*, 17*b*, 25*a*/25*b*, 35*a*/35*b* or 45*a*/45*b* is corresponding to a "snug portion".

The balancers 12C and 22C serve as "resiliently deformed balancers", and the balancers 12C and 22C exert the resilient force on the "part of the inner surface defining said at least one hole" at both ends 12*a*/12*b* and 22*a*/22*b* of the major axes. The direction X is corresponding to a "direction parallel to a longitudinal direction of associated one of said bars".

The constricted holes 11*a*'/11*b*', 21*a*'/31*a*' serve as "at least one constricted hole", and the balancer 13D is corresponding to "associated one of said resiliently deformed balancers". The inner surfaces 16D, 26D, 35D and 46' serve as an "inner surface" defining a constricted portion of said constricted hole.

The thorns 15A/15E, edges 25B, blades 35B and parts 45*a*/45*b* of circumferences serve as "at least one lodged portion", and are corresponding to "at least one projection". The stem portion and head portion 13A/14A, column portions 24B and hexagonal disk portions 23B except the edges 25B, stem portion 33B or column body 43B are corresponding to a "body". The hexagonal disk portions 23B serve as "polygonal portions".

What is claimed is:

1. A method for securing a balancer to a bar of a key incorporated in a keyboard musical instrument, said balancer having a body portion, said method comprising:

preparing said balancer having projections projecting in a radial direction from a surface of said body portion, at least one of said projections having a sharp tip portion pointed away from said surface in said radial direction;

preparing a bar formed with a hole;

inserting said balancer into said hole without rotating said balancer; and rotating said balancer in said hole after said balancer is inserted into said hole so as to make said at least one of said projections lodged in said bar.

2. The method as set forth in claim 1, wherein said projections are implemented by thorns, and said thorns bite into said bar through the rotating motion.

3. The method as set forth in claim 2, wherein said thorns form four pairs, the thorns of each of said four pairs are spaced from each other in a direction in which said balancer is inserted into said hole, and each pair of said thorns is spaced from the adjacent two pairs of said thorns by 90 degrees.

4. The method as set forth in claim 1, wherein said body has plural polygonal portions, and said plural polygonal portions have edges serving as said projections.

5. The method as set forth in claim 1, wherein said projections are implemented by blades, and said blades bite into said bar through the rotating motion.

6. The method as set forth in claim 5, wherein said blades form two pairs spaced from one another by 180 degrees, and the blades of each of said two pairs are spaced from each other in a direction in which said balancer is inserted into said hole.

7. The method as set forth in claim 1, wherein said balancer has a column shape, and part of the circumferences of the end surfaces of said column shape serves as said at least one lodged projection.

8. The method as set forth in claim 1, wherein said at least one lodged projection is lodged in said bar through the motion of said balancer selected from the group consisting of rotation, sliding and inclination.

9. The method as set forth in claim 1, wherein said balancer is formed with a polygonal hollow space, and a tool is inserted into said polygonal hollow space for rotating said balancer.

10. The method as set forth in claim 1, wherein said balancer is pinched with a tool for rotating said balancer.

11. The method of claim 1, wherein said hole has a center axis and is defined by an inner surface, and said inserting further comprises forming straight grooves in the inner surface that are parallel to the center axis.

12. The method as set forth in claim 1 wherein the at least one projection is pyramidal in shape and the radially extending sharp tip portion is the tip of said pyramid that cuts into a wall of said hole in said bar.

* * * * *